US007075493B2

(12) United States Patent
Azadegan et al.

(10) Patent No.: US 7,075,493 B2
(45) Date of Patent: Jul. 11, 2006

(54) SLOT ANTENNA

(75) Inventors: Reza Azadegan, Ann Arbor, MI (US); Kamal Sarabandi, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 10/511,858

(22) PCT Filed: May 1, 2002

(86) PCT No.: PCT/US02/13821

§ 371 (c)(1),
(2), (4) Date: Oct. 14, 2004

(87) PCT Pub. No.: WO03/094293

PCT Pub. Date: Nov. 13, 2003

(65) Prior Publication Data

US 2005/0231434 A1 Oct. 20, 2005

(51) Int. Cl.
*H01Q 13/10* (2006.01)

(52) U.S. Cl. ..... 343/767; 343/895

(58) Field of Classification Search ..... 343/767, 343/770, 895

See application file for complete search history.

(56) References Cited

U.S. PATENT DOCUMENTS 5,081,466 A * 1/1992 Bitter, Jr. ..... 343/767
5,467,099 A * 11/1995 Bonebright et al. ..... 343/767
5,815,122 A * 9/1998 Nurnberger et al. ..... 343/767
6,081,239 A 6/2000 Sabet et al.

(Continued)

FOREIGN PATENT DOCUMENTS

US 2002/0000944 1/2002

(Continued)

OTHER PUBLICATIONS

Azadegan R et al: "Design of Miniaturized Slot Antennas" IEEE Antennas and Propagation Society International Symposium, 2001 Digest APS. Boston, MA. Jul. 8-13, 2001, New York, NY: IEEE, US, vol. 4 of 4, Jul. 8, 2001 pp. 565-568, XP001072153 ISBN: 0-7803-7070-8 the whole document.

(Continued)

*Primary Examiner*—Tan Ho
(74) *Attorney, Agent, or Firm*—Young & Basile, P.C.

(57) ABSTRACT

The present invention disclosed design aspects and the measured results of a miniaturized resonant narrow slot antenna. The resonant narrow slot radiating elements have a planar geometry and are capable of transmitting vertical polarization when placed nearly horizontal. A resonant narrow slot antenna according to the present invention simplifies impedance matching. Slot dipoles can be excited by a microstrip line and can be matched to arbitrary line impedances by moving the feed point along the slot. Antenna miniaturization can be achieved by using a high permittivity or permeability substrate and superstrate materials and/or using an appropriate antenna topology. Miniaturization is achieved through providing a unique geometry for a resonant narrow slot antenna. A very efficient radiating element is provided. With the virtual enforcement of the required boundary condition at the end of a slot antenna, the area occupied by the resonant antenna can be reduced. To achieve the required virtual boundary conditions, the two short-circuit at the end of resonant slot are replaced by some reactive boundary conditions, including inductive or capacitive boundary conditions, including inductive or capacitive loadings.

23 Claims, 18 Drawing Sheets

U.S. PATENT DOCUMENTS

| | | | | |
|---|---|---|---|---|
| 6,313,797 | B1 | 11/2001 | Kurita et al. | |
| 6,411,181 | B1 * | 6/2002 | Ishikawa et al. | 333/219 |
| 6,452,560 | B1 * | 9/2002 | Kunysz | 343/770 |
| 6,480,162 | B1 | 11/2002 | Sabet et al. | |
| 6,509,880 | B1 | 1/2003 | Sabet et al. | |
| 6,573,872 | B1 * | 6/2003 | Oberschmidt et al. | 343/767 |
| 6,593,895 | B1 * | 7/2003 | Nesic et al. | 343/795 |
| 6,664,932 | B1 | 12/2003 | Sabet et al. | |
| 6,791,497 | B1 * | 9/2004 | Winebrand et al. | 343/702 |
| 6,876,334 | B1 * | 4/2005 | Song et al. | 343/767 |

FOREIGN PATENT DOCUMENTS

| | | |
|---|---|---|
| US | 2002/0057220 | 5/2002 |
| US | 2002/0175879 | 11/2002 |
| US | 2004/0056812 | 3/2004 |

OTHER PUBLICATIONS

Sarabandi K et al: "Design of an efficient miniaturized UHF planar antenna" IEEE Antennas and Propagation Society International Symposium, 2001 Digest. APS. Boston, MA, Jul. 8-13, 2001, New York, NY: IEEE, US, vol. 1 of 4, Jul. 8, 2001, pp. 446-449, XP010564673 ISBN: 0-7803-7070-8 the whole document.

Michael A. Forman & Zoya B. Popovic, Department of Electrical Engineering, University of Colorado, Boulder, Co, "A Tunable Second-Resonance Cross-Slot Antenna"; IEEE 1997, 0-7803-4178-3/97, pp. 18-21.

Peroulis D et al: "A Planar vhf Reconfigurable Slot Antenna" IEEE Antennas and Propagation Society International Symposium. 2001 Digest. APS. Boston, MA. Jul. 8-13, 2001, New York, NY: IEEE, US. vol. 1 of 4, Jul. 8, 2001 pp. 154-157, XP001072179 ISBN: 0-7803-7070-8 the whole document.

Tunable Dipole Antennas; D.J. Roscoe, L. Shafai, A. Ittipiboon, M. Cuhaci, R. Douville; Communications Research Centre, 3701 Carling Ave., P.O. Box 11490, Station H, Ottawa, Ontario, K2H 8S2, Canada; Department of Electrical Engineering; University of Manitoba, 1993 IEEE; 0-7803-1246-5/93, pp. 672-675.

A Slot Antenna with Electronically Tunable Length; Shigeo Kawasaki, & Tatsuo Itoh, Department of Electrical and Computer Engineering, The University of Texas at Austin, Texas 78712, 91CH-3036-1/0000-0130; 1991 IEEE, pp. 130-133.

* cited by examiner

SLOT ANTENNA

STATEMENT REGARDING FEDERALLY SPONSORED RESEARCH OR DEVELOPMENT

The U.S. Government may have a paid-up license in this invention and the right in limited circumstances to require the patent owner to license others on reasonable terms as provided for by the contract No. DAAD 19-99-1-0197 by the U.S. Army Research Office.

FIELD OF THE INVENTION

The present invention relates to efficient miniaturized resonant slot antennas, and more particularly to loaded resonant slot antennas, or folded resonant narrow slot antennas.

BACKGROUND OF THE INVENTION

The topic of small antennas has been of prolonged interest and goes back more than half a century. Using the area of the substrate more effectively in microwave circuits, as part of a general trend in monolithic circuit integration and antenna invisibility for certain applications, has been among the major motivations. On the other hand, in the radio communication, where the line of sight communication is not generally possible, the UHF-VHF frequencies should be used. At these low frequencies, the size of even a single half wave dipole antenna is preclusive in many mobile and wireless applications.

The subject of antenna miniaturization is not new. The literature concerning this subject date back to the early 1940's. It has been shown that the Q factor of the equivalent circuit for each spherical mode can be expressed in terms of the normalized radius ($a/\lambda$) of the smallest sphere enclosing the antenna and also the Q of the lowest order mode is a lower bound for the Q of a single resonant antenna. A similar procedure is used, for characterization of a small dipole antenna using cylindrical wave functions. Then a cylindrical enclosing surface is used which produces a tighter lower bound for the Q of small antennas with large aspect ratios such as dipoles and helical antennas. Qualitatively, these studies show that for single resonant antennas, the smaller the maximum dimension of an antenna is, the higher the Q of the antenna or equivalently the lower the bandwidth of the antenna. However, the studies do not provide a description of the process for practicing the miniaturization methods, antenna topology, or impedance matching.

Normally, there is a compromise between the size, efficiency and bandwidth of the antenna. It is known to address this subject by expanding fields of an arbitrary small antenna enclosed in a sphere, using spherical eigen-functions expansion. The Q of the antenna, which is by definition the ratio of the stored energy to the radiated power, can be related to the Q of each eigen-mode. This approach introduces a lower bound on the Q of the antenna. The calculated Q is a function of radius of the sphere or correspondingly the largest dimension of the antenna. On the other hand, a lower bound on Q in some senses is an indication of an upper limit on the antenna bandwidth. There are two ways to achieve miniaturization. One is to use a high permittivity substrate and the other is to exploit the substrate area in two dimensions by changing the topology of the antenna With the advent of wireless technology and ever increasing demand for high data rate mobile communications the number of radios on mobile platforms has reached a point that the available real estate for these antennas has become a serious issue. Similar problems are also emerging in the commercial sector where the number of wireless services planned for future automobiles, such as FM and CD radios, analog and digital cell phones, GPS, keyless entry and etc., is on the rise. Considering wave propagation where line-of-sight communication is an unlikely event, such as in an urban environment or over irregular terrain, carrier frequencies at HF-UHF band are commonly used. At these frequencies there is considerable penetration through vegetation and buildings, wave diffraction around obstacles, and wave propagation over curved surfaces. However at these frequencies the size of efficient antennas are relatively large and therefore a large number of such antennas may not fit in the available space without the risks of mutual coupling and co-site interference. Efficient antennas require dimensions of the order of half a wavelength for single frequency operation. To cover a wide frequency range, broadband antennas may be used, however, dimensions of these antennas are comparable to or larger than the wavelength at the lowest frequency. Besides, depending on the applications, the polarization and the direction of maximum directivity for different wireless systems operating at different frequencies may be different and hence a single broadband antenna may not be sufficient. It should also be noted that any type of broadband antenna is highly susceptible to electronic jamming techniques. Variations of monopole and dipole antennas in use today are prohibitively large and bulky at HF through VHP.

SUMMARY OF THE INVENTION

An important component of any wireless system is its antenna. With recent advances in solid state devices and MEMS technology, construction of high performance miniaturized transmit and receive modules have become realizable. These modules together with miniaturized sensors and transducers have found numerous applications in industry, medicine, and military. In addition to the need for antenna miniaturization, low power characteristics of such transmitters and receivers are extremely important as well. Whereas significant efforts have been devoted towards achieving low power and miniaturized electronic and RF components, issues related to design and fabrication of efficient, miniaturized, and easily integrable antennas have been overlooked. The early studies of small antennas were restricted to the establishment of fundamental limitations of these types of antennas with regard to the antenna size and bandwidth. In recent years, the practical aspect of antenna miniaturization has received significant attention. Most successful designs, however, rely on the use of high permittivity ceramics, which are not suitable for monolithic integration. The present invention builds on the concept of a class of miniaturized, planar, re-configurable antennas, which take advantage of antenna topology for miniaturization. Using this concept, design of a miniaturized antenna as small as $0.05\ \lambda_0 \times 0.05\ \lambda_0$ and a fairly high efficiency of −3 dBi can be accomplished. Since there are neither polarization nor mismatch losses, the antenna efficiency is limited only by the dielectric and Ohmic losses of the substrate on which the antenna is made. The bandwidth of this antenna is rather small as is the case for all miniaturized antennas. Resonant antennas in general, and slot-dipoles in particular are inherently narrow-band. By reducing the size of a slot, the physical aperture of the antenna is reduced and therefore, the radiation conductance of miniaturized slot antenna becomes very small. On the other hand, an infinitesimal dipole can have an effective aperture, which is as high as that of a half wavelength dipole under the impedance matched condition. One way to match the impedance of the miniaturized slot antenna is to tune it slightly off resonance, whether capacitively, or inductively. A smaller capacitance or larger inductance is needed depending on whether the antenna is tuned below or above the resonance. However, a smaller capacitance, or conversely a larger inductance, results in a narrower bandwidth To partially improve the bandwidth of the miniaturized slot antenna, the physical aperture can be increased without increasing the overall size of the antenna.

The present invention takes advantage of the topology of the antenna. Generally, in resonance antennas two boundary conditions are required in conjunction with the Maxwell's equation. The natural frequency of the system is defined by the eigen-values of the describing equations. In a simple half wave dipole these two conditions are chosen to be an open circuit (zero current) at both wire ends. Similarly, in the dual problem of a slot antenna, the electric field is shortened by the ground, which gives the traditional half wavelength slot antenna. The choice of these two boundary conditions is somewhat arbitrary and enforcing a more cleverly chosen boundary condition would result in a smaller antenna. The boundary condition has been devised for matching short dipole antennas by top loading and also center loading. In what follows a general procedure for the design of a small slot antenna is presented. Then simulation results for prototype antennas as well as the input impedance and radiation patterns of the antennas are presented and compared with the measurements. According to the present invention, the topology of an efficient, miniaturized, resonant slot antenna is disclosed and then the radiation, input impedance, and bandwidth characteristics of the antenna are investigated. This class of antennas can exhibit simultaneous band selectivity and anti-jam characteristics in addition to possessing a planar structure and low profile, which is easily integrable with other RE and microwave circuits.

This miniaturization for a resonant slot dipole is achieved by noting that a slot dipole can be considered as a transmission line resonator, where at the lowest resonant frequency the magnetic current (transverse electric field in the slot) goes to zero at each end of the dipole antenna. At the operating frequency the antenna length $l=\lambda_g/2$ where $\lambda_g$ is the wavelength of the quasi-TEM mode supported by the slot line. In view of transmission line resonators one can also make a quarter-wave resonator by creating a short circuit at one end and an open circuit at the other end. However, creating a physical open circuit for slot lines is not practical. Basically, a spiral slot of a quarter wavelength and shorted at one end behaves as an open circuit at the resonant frequency. With this invention the size of the slot dipole can be reduced by approximately 50%. Further reduction can be accomplished by bending the radiating section. This bending procedure should be done so that no section of the resulting line geometry carries a magnetic current opposing the current on any other sections.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1A:
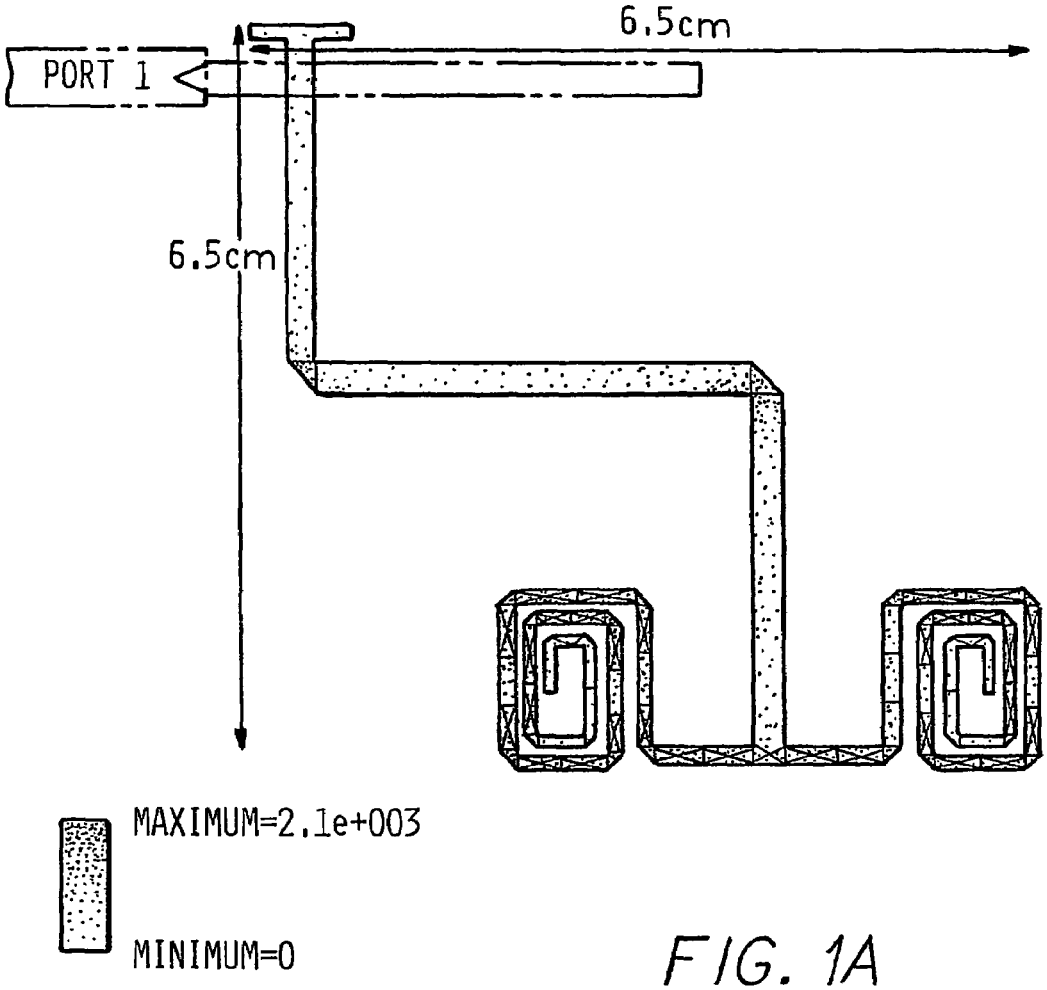
FIG. 1A is a magnetic current distribution on a ultra high frequency (UHF) miniaturized slot antennae illustrating the ground-plane side of the antennae and meshing configuration used in method of moments calculations.
Figure 1B:
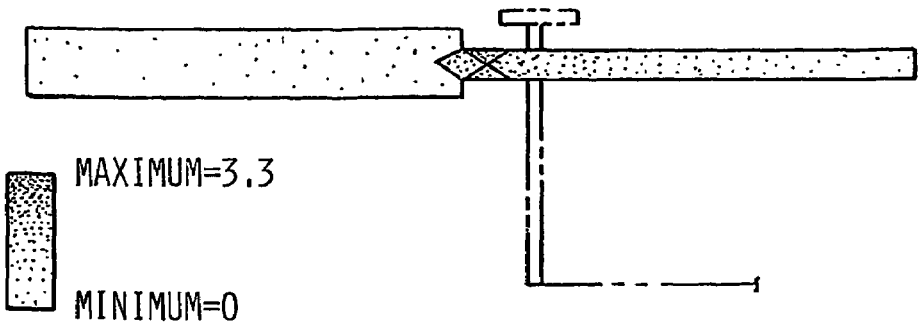
FIG. 1B is an electric current distribution on a microstrip feed of the slot antennae of FIG. 1A at the resonant frequency.

A major reduction in size is achieved by noting that a slot dipole can be considered as transmission line resonator where at the lowest resonant frequency the magnetic current (transverse electric field in the slot) goes to zero at each end of the dipole antenna. As mentioned before at this frequency the antenna length $l=\lambda_g/2$ where $\lambda_g$ is the wavelength of the quasi-TEM mode supported by the slot line. $\lambda_g$ is a function of substrate thickness, dielectric constant, and the slot width, which is shorter than the free-space wavelength In view of transmission line resonators one can also make a quarter-wave resonator by creating a short circuit at one end and an open circuit at the other end. However, creating a physical open circuit for slot lines is not practical. The present invention incorporates the idea of non-radiating tightly coiled slot spiral. Basically, a spiral slot of a quarter wavelength and shorted at one end behaves as an open circuit at the resonant frequency. Therefore a quarter-wave slot line short-circuited at one end and terminated by the non-radiating quarter-wave spiral should resonate and radiate electromagnetic waves very efficiently. With this topology the size of the slot dipole can be reduced by approximately 50%. Further reduction can be accomplished by bending the radiating section. This bending procedure should be done so that no section of the resulting line geometry carries a magnetic current opposing the current on any other sections. FIGS. 1A and 1B shows the geometry of a typical $\lambda_g/4$ compact resonating slot antenna. The radiating section is terminated with two identical quarter-wave non-radiating spiral slots to maintain the symmetry. It was found that by splitting the magnetic current at the end into equal and opposing magnetic currents the radiation efficiency is enhanced. Since the magnetic current distribution attains its maximum at the end of the quarter-wave line, the magnetic current in the beginning segments of a single (unbalanced) quarter-wave spiral reduces the radiation of the radiating section. But the opposite magnetic currents on two such spirals simply cancel the radiated field of each other and as a result the radiated field of the radiating section remains intact. Some additional size reduction can also be-achieved, by noting that the strength of the magnetic current near the short-circuited end of the radiating section is insignificant. Hence, bending this section of the line does not significantly reduce the radiation efficiency despite allowing opposing currents. In FIG. 1A the T-top represents a small reduction in length of the line without affecting the radiation efficiency. This antenna is fed by an open ended microstrip line. A quarter wavelength line corresponds to a short-circuit line under the slot, however, using the length of the microstrip line as an adjustable parameter, the reactive part of the antenna input impedance can be compensated for.

EXAMPLE I

FIGS. 1A and 1B respectively, show the electric current distribution on the microstrip feed and the magnetic current distribution on the slot of the compact UHF antenna designed to operate at 600 MHZ. An ordinary FR4 substrate with thickness of 3 mm (120 mil.) and dielectric constant $\in_r=4$. PiCASSO™ software was used for the simulations of this antenna. The microstrip feed is constructed from two sections: 1) a 50Ω line section, and 2) an open-ended 80Ω line. The 80Ω line is thinner which allows for compact and localized feeding of the slot. The length of this line is adjusted to compensate for the reactive component of the slot input impedance. Noting that the slot appears as a series load in the microstrip transmission line, a line length of less than $\lambda_m/4$ compensates for an inductive reactance and a line length of longer than $\lambda_m/4$ compensates for a capacitive reactance. Here $\lambda_m$ is the guided wavelength on the microstrip line. First a quarter wavelength section was chosen for the length of the microstrip line feeding the slot. In this case the simulation predicts the impedance of the slot antenna alone. Through this simulation it was found that the slot antenna fed near the edge is inductive. So a length less than $\lambda_m/4$ is chosen for the open-ended microstrip line to compensate for the inductive load. The real part of input impedance of a slot dipole depends on the feed location along the slot and increases from zero at the short-circuited end to about 2000Ω at the center (quarter wavelength from the short circuit). This property of the slot dipole allows for matching to almost all practical transmission lines. The crossing of the microstrip line over the slot was determined using the full-wave analysis tool, (PiCASSO™) and by trial-and-error. The uniform current distribution over the 50Ω line section indicates no standing wave pattern, which is a result of a very good input impedance match Apart from the T-top section, the quarter-wave radiating section of the slot dipole is composed of three slot line sections, two vertical and one horizontal. Significant radiation emanates from the middle and lower sections. Polarization of the antenna can be chosen by changing the relative size of these two sections. In this design the relative lengths of the three line sections were chosen in order to minimize the area occupied by the slot structure. The slot width of the first section can be varied in order to obtain an impedance match as well. When there is a limitation in moving the microstrip and slot line crossing point, the slot width may be changed. At a given point from the short-circuited end an impedance match to a lower line impedance can be achieved when the slot width is narrowed. This was used in this design, as the slot line width of the top vertical section is narrower than the other two sections. It should be pointed out that by narrowing the slot line width the magnetic current density increases, but the total magnetic current in the line does not. In other words there is no discontinuity in the magnetic current along the line at points where the slot width is changed, however, there are other consequences. One is the change in the characteristic impedance of the line and the second is the change in the antenna efficiency considering the finite conductivity of the ground plane. There are two components of electric current flowing on the ground plane, one component flows parallel to the edge and the other is perpendicular. For narrow slots the current density of the parallel component near the edge goes up and as a result this current sees a higher ohmic resistance. The magnetic current over the T-top section is very low and does not contribute to the radiated field but its length affects the resonant frequency. Half the length of the T-top section originally was part of the first vertical section, which is removed and placed horizontally to lower the vertical extent of the antenna.

Figure 2A:
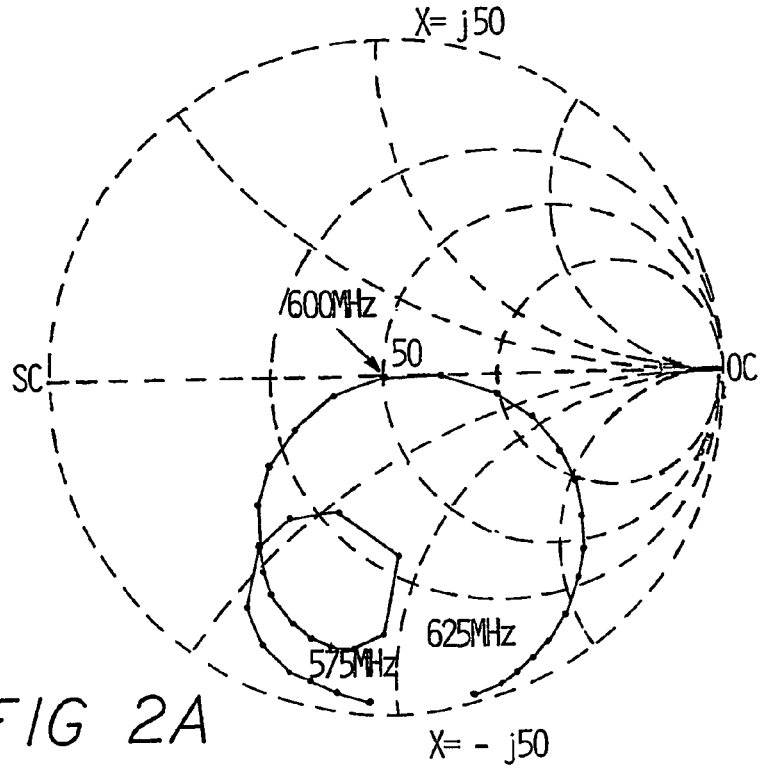
FIG. 2A is a simulated reflection co-efficient of the miniaturized UHF antennae on an infinite ground plane using Smith chart representation.
Figure 2B:
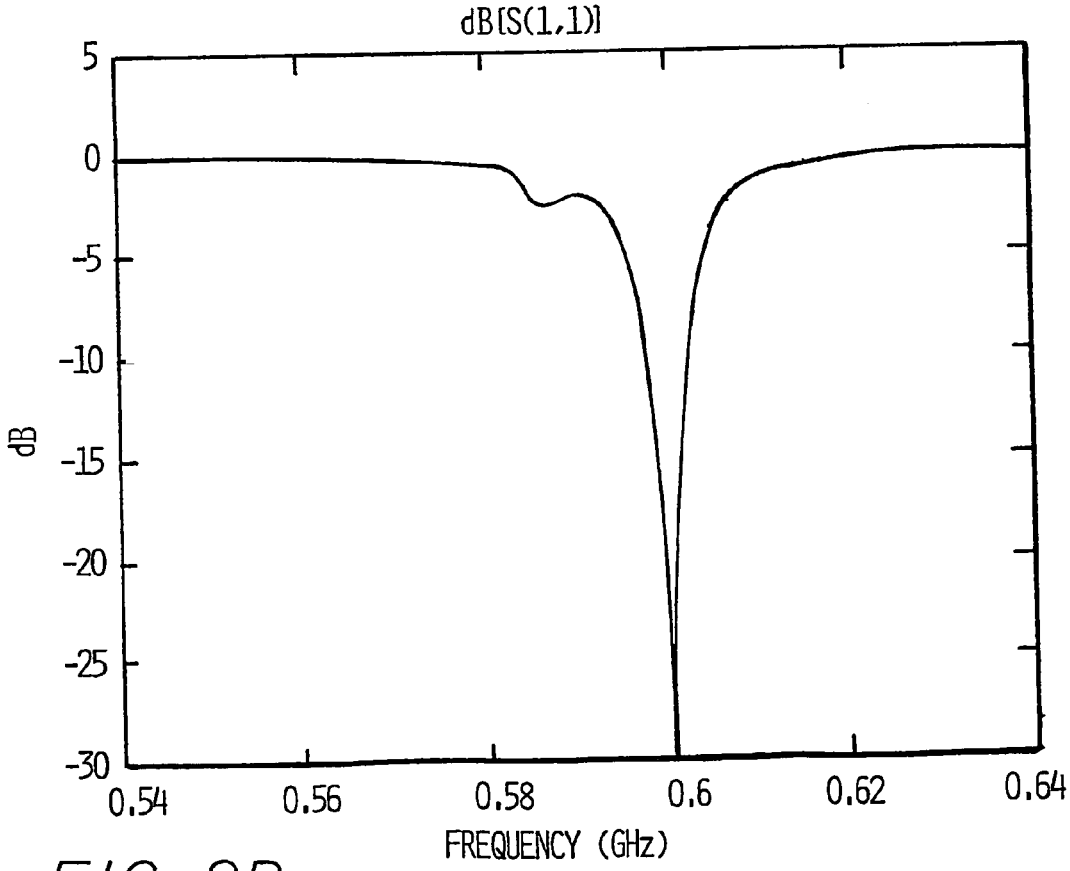
FIG. 2B is a simulated reflection co-efficient of the miniaturized UHF antennae on an infinite ground plane with magnitude of $/S_{11}/$ in logarithmic scale.

The slot line sections were chosen so that a resonant frequency of 600 MHz was achieved. At this frequency the slot antenna occupies an area of (6.5 cm×6.5 cm) or in terms of the free-space wavelength $0.12\ \lambda_0 \times 0.12\ \lambda_0$. FIGS. 2A and 2B respectively, show the simulated input impedance and return loss of the miniaturized UHF antenna as a function of frequency. It is shown that the 1.2 VSWR (−10 dB return loss) bandwidth of this antenna is around 6 MHZ which corresponds to a 1% fractional bandwidth. This low bandwidth is a characteristic of miniaturized and resonant slot dipoles. The simulation also shows a weak resonance, which may be caused by the interaction between the radiating element and the non-radiating spirals. In fact careful examination of the magnetic current distributions over the non-radiating spirals shows the asymmetry caused by the near field interaction of the radiating element with the non-radiating spirals.

The polarization of this antenna may appear to be rather unpredictable at a first glance due to its convoluted geometry. However, it can be conjectured that the polarization of any miniaturized antenna whose dimensions are much smaller than a wavelength cannot be anything other than linear. This is basically because of the fact that the small electrical size of the antenna does not allow for a phase shift between two orthogonal components of the radiated field required for producing an elliptical polarization. Hence by rotating the antenna a desired linear polarization along a given direction can be obtained.

EXAMPLE II

Figure 3:
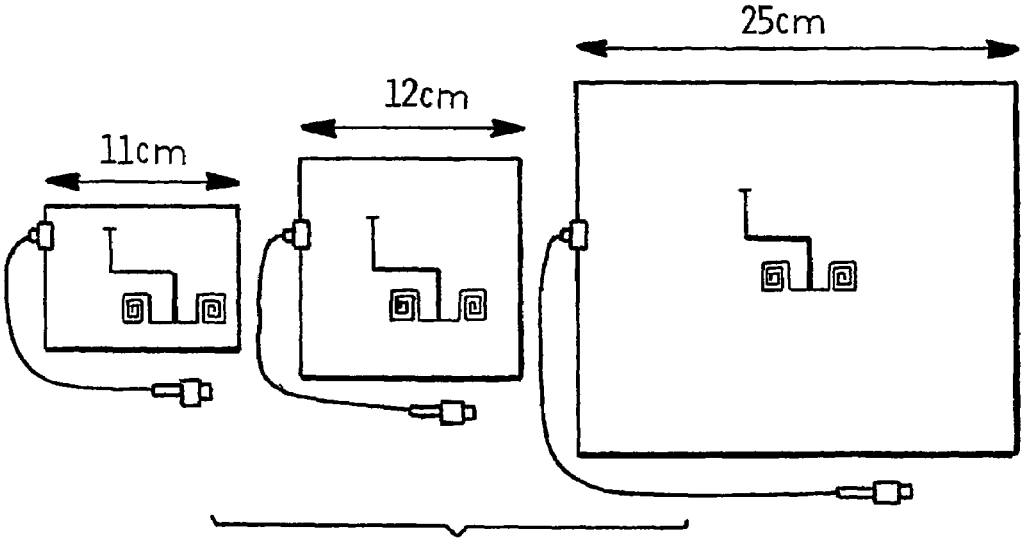
FIG. 3 is a photograph of three miniaturized UHF antennas with similar geometry and dimensions while differing only in the size of the ground plane.
Figure 4:
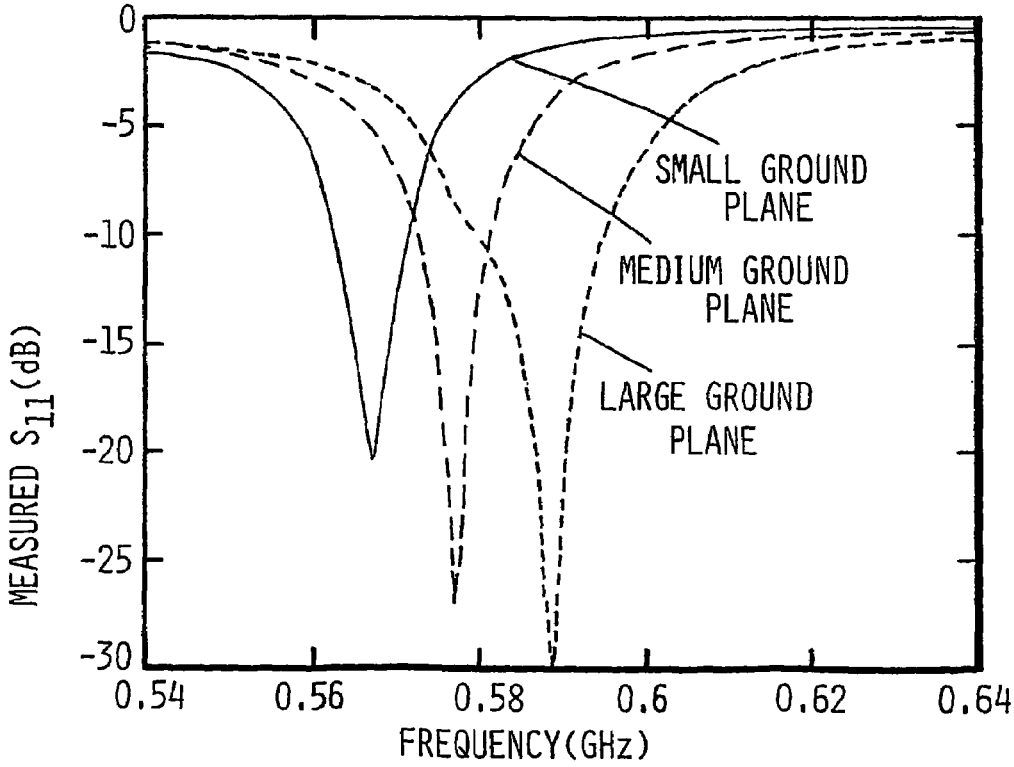
FIG. 4 is a graph illustrating measured magnitude of reflection co-efficient for the three miniaturized UHF slot antennas shown in FIG. 3 having the same size in geometry while having different ground plane sizes.
Figure 6:
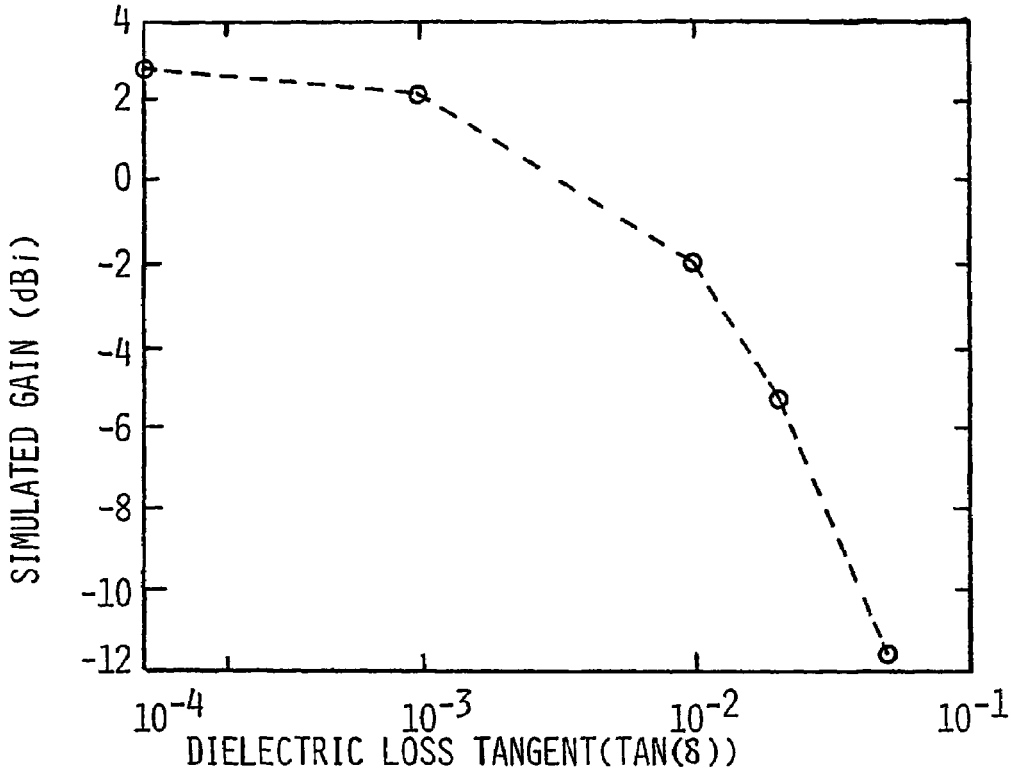
FIG. 6 is a simulated gain of the UHF miniaturized antennae on an infinite substrate with $\in_r=4.0(1-j\tan\delta)$.

An antenna based on the layout shown in FIGS. 1A and 1B was made on a FR4 printed-circuit-board. In the first realization, the size of the ground plane was chosen to be 8.5 cm×11 cm. The return loss of this antenna was measured with a network analyzer and the result is shown by the solid line in FIG. 4. It is noticed that the resonant frequency of this antenna is at 568 MHz, which is significantly lower than what was predicted by the simulation. Also the measured return loss for the designed microstrip feed line was around −10 dB. To get a better return loss the length of the microstrip line had to be extended slightly. FIG. 4 shows the measured return loss after the modification. The gain of this antenna was also measured against a calibrated antenna. Under a polarization matched condition a gain of −5.0 dBi (gain in dB against an isotropic radiator) is measured. The simulated gain value of this antenna using an infinite ground plane and $\in=4.0$ is found to be 2.8 dBi. The difference in the simulation results and the measured ones can be attributed to the finiteness of the ground plane, finite conductivity of the ground plane, and the loss-tangent of the substrate. The effect of the imaginary part the substrate dielectric constant ($\in=4.0-j\in''$) can be quantified using a numerical simulation. FIG. 6 shows the simulated gain values of this antenna as a function of $\in''$ with an infinite ground plane. It is shown that, as expected, the gain is decreased when the loss tangent is increased. Hence it is very important to use substrates with very low loss tangent. The FR4 used for this antenna has a loss tangent ($\tan\delta\approx0.01$) at UHF. To investigate the effect of ground plane size on the resonance frequency and radiation efficiency, two more antennas having the same geometry and dimensions but with different ground plane sizes were made. The measured resonant frequencies are also shown in FIG. 4. FIG. 3 shows a photograph of these antennas. The dimensions of the ground planes and the measured gain of these antennas are reported in Table 1.

TABLE 1

The resonant frequencies gains and the ground plane sizes of three identical UHF miniaturized slot antennas. Here the effect of ground plane size on the resonant frequency and antenna gain is demonstrated.

| | Ground Plane Size | Resonant Frequency | Gain (dBi) |
|---|---|---|---|
| Antenna 1 | 8.5 cm × 11 cm | 568 MHZ | −5.0 |
| Antenna 2 | 12 cm × 13 cm | 577 MHz | −2.0 |
| Antenna 3 | 22.5 cm × 25 cm | 592 MHz | 0.5 |

As expected the resonant frequency and the gain of the antenna approaches the predicted values as the size of the ground plane is increased. The gain of Antenna 3 is almost as high the gain of an ideal dipole considering the loss-tangent of the substrate used in these experiments.

The gain reduction as a function of ground plane size can be explained by noting that the equivalent magnetic currents that are flowing in the upper and lower side of the ground plane are in opposite directions. In the case of infinite ground plane, the upper and lower half-spaces are electromagnetically decoupled. However, when the ground plane is finite and small compared to the wavelength the radiated field from the lower half-space can reduce the radiated field from the magnetic current in the upper half-space. The level of back-radiation depends on the size of the ground plane. In other words, the smaller a ground plane is the higher back-radiation becomes. Ignoring the substrate ($\in_r=1$), radiation from the upper and lower magnetic currents completely cancel each other in the plane of the perfect conductor (creates a null in the radiation pattern). However, because of the substrate and depending on its thickness and relative dielectric constant a perfect cancellation does not occur. This explains the discrepancies observed between the measured and predicted radiation patterns (for infinite ground plane). Also there are strong edge currents on the periphery of a finite ground which decreases as the size of the ground plane is increased. The confined currents around the edge experience an ohmic loss which is responsible for the decrease in the antenna gain.

Figure 5A:
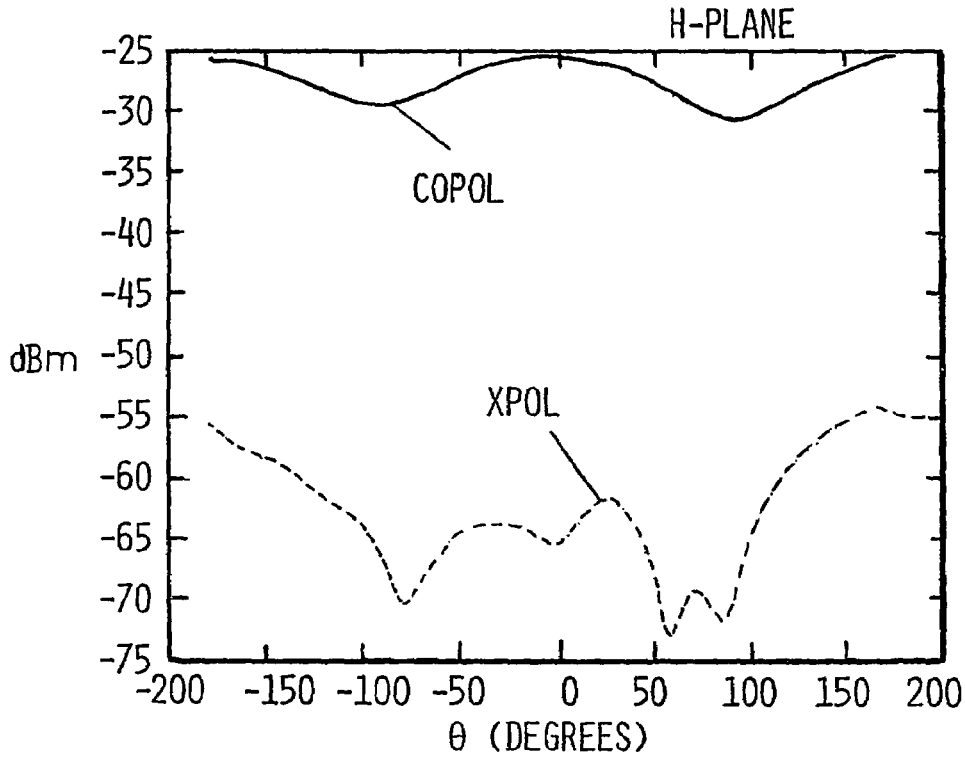
FIG. 5A is a graph illustrating the co-polarized and cross-polarized pattern of the miniaturized UHF antennae in H-plane.
Figure 5B:
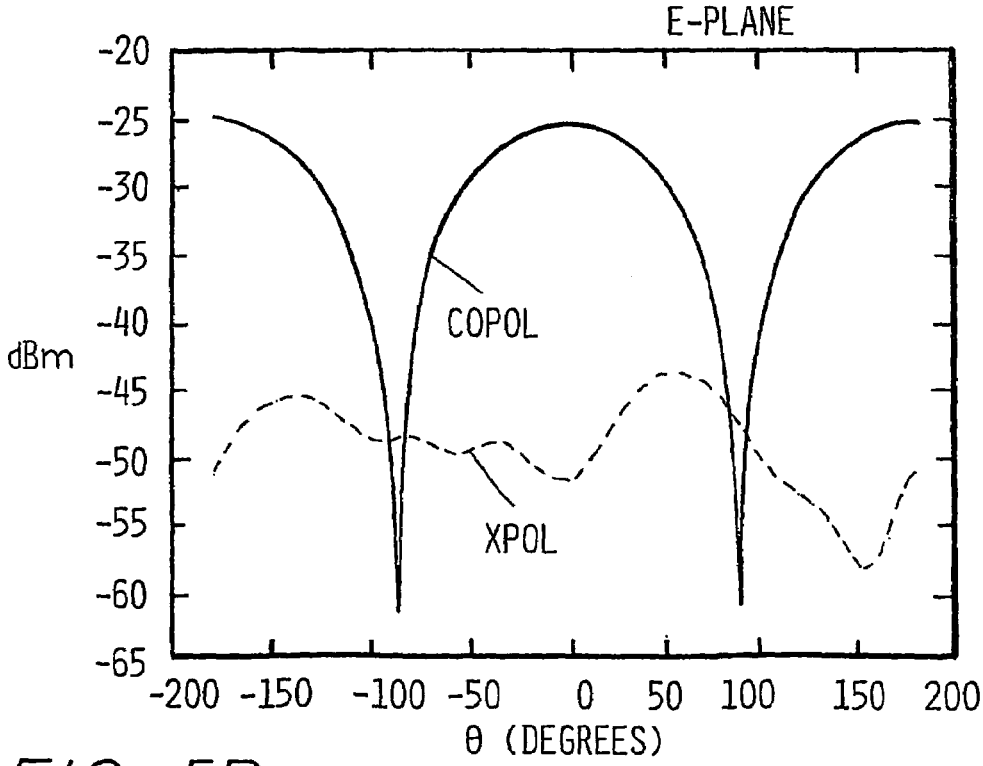
FIG. 5B is a graph illustrating the co-polarized and cross-polarized pattern of the miniaturized UHF antennae in E-plane.
Figure 7:
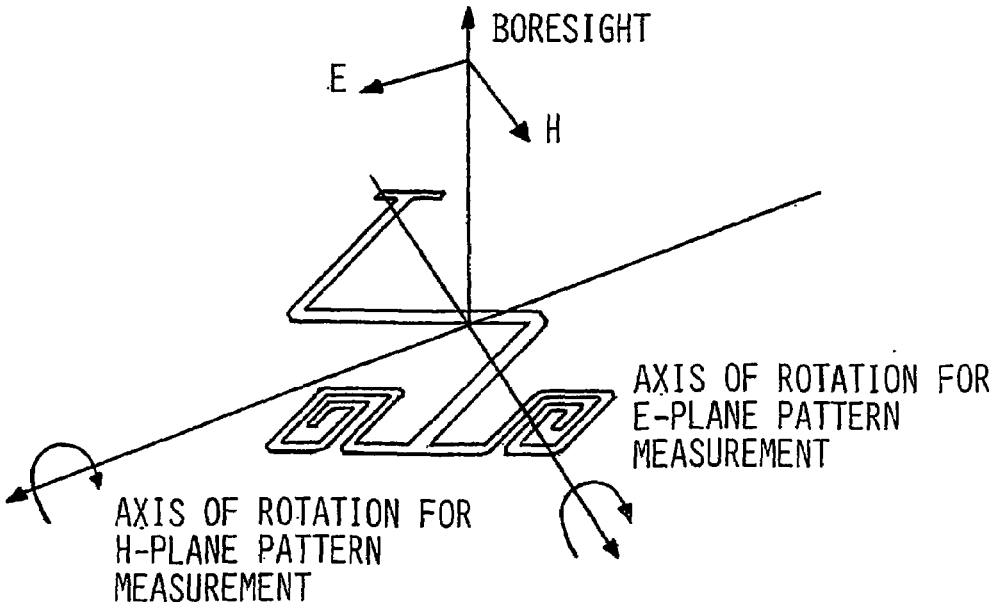
FIG. 7 is a simplified schematic view illustrating E-plane and H-plane of the slot antennae being tested experimentally with co-polarized and cross-polarized pattern measurements performed in the indicated principle planes.

The radiation pattern of these antennas were also measured in the University of Michigan anechoic chamber. A linearly polarized antenna was used as the reference. First the polarization of the antenna was determined at the direction of maximum radiation (normal to the ground plane). Then by rotating the antenna under test about the direction of maximum radiation, it was found that indeed the polarization of the miniaturized antenna is linear. FIG. 7 shows the direction of maximum radiation and the direction of electric field (polarization) and magnetic field at the antenna boresight. FIGS. 5A and 5B show the co- and cross-polarized antenna patterns in the H-plane and E-plane, respectively. It is shown that the antenna polarization remains linear on these principal planes. As discussed before, the E-plane gain in the plane of the ground plane ($\theta=90°$) drops because of the finiteness of the ground plane. If the substrate were to be removed the E-plane gain in the plane of the conductor would drop to zero. Hence having a thick substrate helps achieving a more uniform pattern. Thick and high permittivity substrate also increases front-to-back radiation ratio. Since the substrate thickness is only a small fraction of the wavelength, almost similar gain values are measured in the upper and lower half-spaces.

It is worth mentioning that further miniaturization can easily be accomplished by increasing the dielectric constant of the substrate. In this case the guide wavelength shortens which in turn allows for a smaller antenna. As previously mentioned further antenna miniaturization is accompanied by a reduction of the antenna bandwidth. Also confining the electric currents on the ground plane into a smaller area results in a higher ohmic loss or equivalently lower antenna efficiency.

According to the present invention, a topology for an electrically small resonant slot antenna is demonstrated. A major size reduction was achieved by constructing a $\lambda_g/4$ resonant slot rather than the traditional $\lambda_g/2$ antenna. This is accomplished by generating a virtual open circuit at one end of the slot. Further miniaturization was achieved by bending the slot into three pieces in order to use the area of the board more efficiently. The antenna geometry occupies a very small area (0.014 $\lambda_0^2$ of a PC board with $\in_r=4.0$ and thickness 3 mm. The antenna is very efficient and shows a gain as high as a dipole antenna and a 1% bandwidth. It is also shown that if the antenna is made on a small ground plane its gain will be reduced and its radiation pattern changes slightly.

A novel procedure according to the present invention allows the design of a miniaturized slot antenna where its dimensions (relative to wavelength) can be arbitrarily chosen depending on the application without any adverse effects on the impedance matching. As will be shown, in order to fine-tune the resonant frequency of this structure, the antenna is first fed by a two-port microstrip line, and then the location of the null in the insertion loss ($S_{21}$) is found and adjusted. To specify the terminating impedance at the second port in such a way that a perfect match is achieved, an equivalent circuit for the antenna is proposed and its parameters are extracted using a genetic algorithm in conjunction with a full-wave simulation tool. Finally, a prototype antenna is designed, fabricated and its performance is evaluated experimentally.

For a resonant slot antenna, two boundary conditions (BC) are applied at both ends of a slot line to form a resonant standing wave pattern. These two conditions are chosen to enforce zero electric current (open circuit) for a wire antenna or zero voltage (short circuit) for the slot antenna and yield a half-wave resonant antenna. On the other hand, these alternative BCs result in a smaller resonant length than a half wavelength antenna. One choice which is conducive to antenna miniaturization is the combination of a short circuit and an open circuit, which allows a shorter resonant length of $\lambda/4$. The choice of the two BCs, however, is not restricted to the above conditions, whereas the effect of reactive BCs in reducing the resonant length and antenna miniaturization is investigated in what follow.

Figure 8:
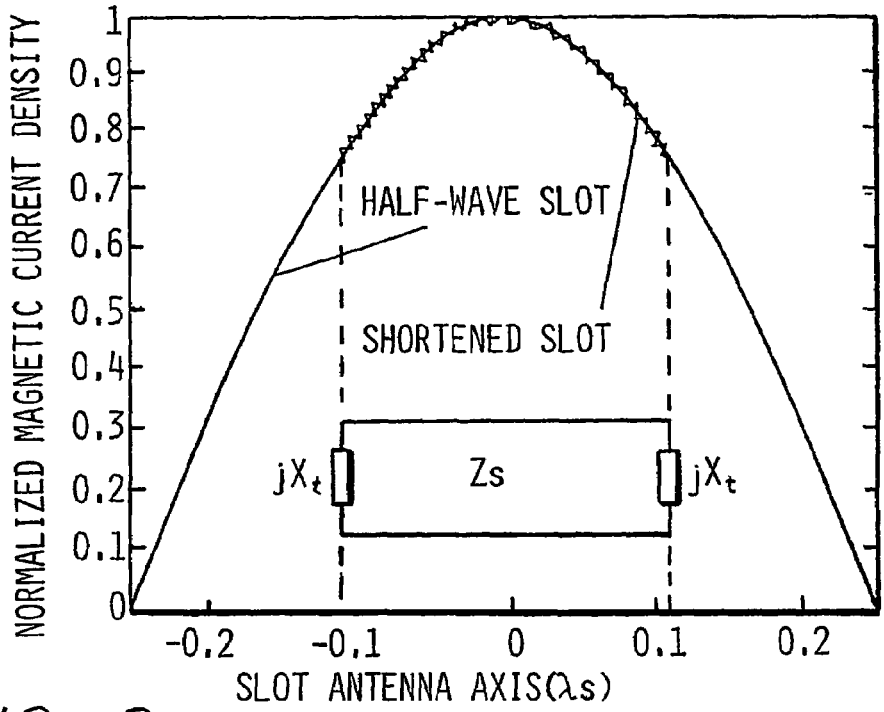
FIG. 8 is a graph illustrating magnetic current distribution of a half wave length and inductively terminated miniaturized slot antennae.

Starting from a $\lambda_S/2$ slot and in the view of the transmission line approximation for the slot dipole, the equivalent magnetic current distribution along a linear slot antenna can be expressed as $$M(z) = M_0\cos\left(\frac{\pi}{\lambda_s}z\right) \tag{1}$$

where $\lambda_g$ is the guided wavelength in the slot-line. In equation (1) $M_0$ represents the amplitude of the magnetic current density (electric field across the slotline). This approximate form of the current distribution satisfies the short circuit boundary conditions at the end of the slot antenna. If by using an appropriate boundary condition, the magnetic current density at any arbitrary point $|z'|<(\lambda_s/4)$ along the length of a modified slot antenna can be maintained the same as the $\lambda/2$ slot antenna, then it is possible to make a smaller slot antenna. Any size reduction of interest can be achieved so long as the appropriate BCs are in place at the proper location on the slot. FIG. 8 illustrates the idea where it is shown that by imposing a finite voltage at both ends of a slot, the desired magnetic current distribution on a short slot antenna can be established. To create a voltage discontinuity, one can use a series inductive element at the end of the slot antenna. It should be pointed out that terminating the slot antenna with a lumped inductance or capacitance is not practical since the slot is embedded in a ground plane, which can in fact short-circuit any termination. To circumvent this problem, a lumped inductor could be physically realized by a compact short-circuited slotted spiral. To ensure inductive loading, the length of the spiral slot must be less than a quarter wavelength Instead of a single inductive element at each end, it is preferred to use two inductive slotlines opposite of each other (see FIG. 9A-9C and FIG. 10). Since these two inductors in the slot configuration are in series, a shorter slotline provides the required inductive load at the end of the slot antenna. Another reason for choosing this configuration is that the magnetic currents following in opposite directions cancel each other's fields on the planes of symmetry, and thereby, minimize the near-field coupling effect of the inductive loads on the desired current distribution along the radiating slot. It should be noted that the mutual coupling within the spiral slotline reduces the effective inductance and therefore, a longer spiral length compared with a straight section (FIG. 9A-9C) is needed to achieve the desired inductance. To alleviate this adverse effect, a narrower slot width must be chosen for the spiral slotline.

A microstrip transmission line is used to feed this antenna. The choice of the microstrip feed, as opposed to a coaxial line, is based on the ease of fabrication and stability. This feed structure is also more amenable to tuning by providing the designer with an additional parameter. Instead of short-circuiting the microstrip line over the slot, an open-ended microstrip line with an appropriate length extending beyond the microstrip-slot crossing point (additional parameter) can be used. A Coplanar Waveguide (CPW) can also be used to feed the antenna providing ease of fabrication, whereas it is more difficult to tune. Usually, a metallic bridge is needed to suppress the odd mode in the CPW. The use of CPW lines also reduces the effective aperture of the slot antenna, especially when a very small antenna is to be matched to a 50Ω line. Typically for a low dielectric constant substrate, the center conductor in the CPW lines at 50Ω is rather wide and the gap between the center conductor and the ground planes is relatively narrow. Hence, feeding the slot antenna from the center blocks a considerable portion of the miniaturized slot antenna. There are other methods to feed the slot antenna with CPW lines, including an inductively or capacitively fed slot A procedure according to the present invention provides for designing a novel miniaturized antenna with the topology discussed in the previous section. To illustrate this procedure, a miniaturized slot antenna at 300 MHz is designed. This frequency is the lowest frequency at which accurate antenna measurements can be performed in the anechoic chamber, and yet, the miniature antenna is large enough so that standard printed circuit technology can be used in the fabrication of the antenna. A microwave substrate with a dielectric constant of $\in_r$=2.2, a loss tangent of tan $\delta \approx 10^{-3}$, and a thickness of 0.787 mm (31 mil) is considered for the antenna prototype.

TABLE 2

Slotline characteristics for two different values of slot width w, and the dielectric constant of $\epsilon_r$ = 2.2 and thickness of h = 0.787 (mm) and f = 300 MHz.

| ω(mm) | $\lambda_s$(mm) | $Z_{0s}$(Ω) |
|---|---|---|
| 0.5 | 918 | 81 |
| 3.0 | 960 | 107 |

Figure 9A:
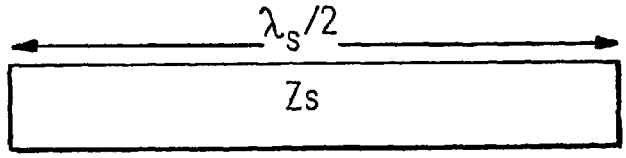
FIG. 9A is a simplified schematic diagram of a transmission line model of a half wave slot antennae.
Figure 9B:
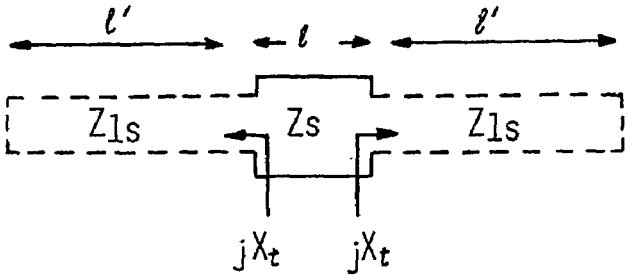
FIG. 9B is a simplified schematic diagram of a transmission line model of an inductively terminated slot antennae.
Figure 9C:
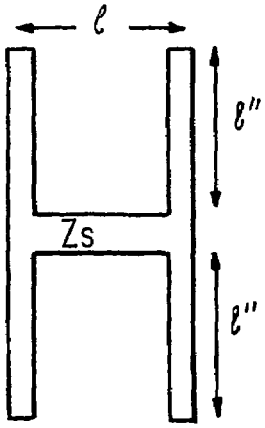
FIG. 9C is a simplified schematic diagram of a transmission line model of a slot antennae with two series inductive terminations.

As the first step, the basic transmission line model is employed to design the antenna and then, a fill-wave Moment Method analysis is used for fine tuning. Table 2 shows the finite ground plane slotline characteristic impedance $Z_{0s}$, and guided wavelength $\lambda_g$, for the above mentioned substrate and for two slot widths of ω=0.5 mm and ω=3.0 mm, all at 300 MHz. As mentioned before, the antenna size can be chosen as a design parameter and in this example, we attempt to design a very small antenna with a length of l=55 mm≈0.05 $\lambda_0$. A slot width of ω=3 mm is chosen for the radiating section of the slot antenna A slot antenna whose radiating slot segment is of a length l, should be terminated by a reactance given by $$X_t = Z_{0s}\tan\frac{2\pi}{\lambda_s}l', \tag{2}$$

in order to maintain the magnetic current distribution of a λs/2 resonant slot antenna (see FIG. 2). In equation (2), $$l' = \frac{1}{2}\left(\frac{\lambda_s}{2} - l\right), \tag{3}$$

and $Z_{0s}$ and $\lambda_s$ are the characteristic impedance and the guided wavelength of the slotline, respectively. As mentioned before, the required terminating reactance of $X_t$ can be constructed by two smaller series slotlines. Denoting the length of a terminating slotline by l", as shown in FIG. 9A–9C, the relationship between the required reactance and l" is given by $$\frac{X_t}{2} = Z'_{0s}\tan\frac{2\pi}{\lambda'_{0s}} \tag{4}$$

where $Z'_{0s}$ and $\lambda'_{0s}$ are the characteristic impedance and the guided wavelength of the terminating slotline. A narrower slot is used to construct the terminating slotlines so that a more compact configuration can be achieved. As shown in Table 2, the narrower slotline has a smaller characteristic impedance and guided wavelength which results in a slightly shorter length of the termination (l"). Although l" is smaller than l' the actual miniaturization is obtained by winding the terminating line into a compact spiral as seen in FIG. 10.

According to equation (2) and equation (4), and also the values for the guided wavelengths, l" is found to be l"=193.7 mm. Referring to FIG. 10, the vertical dimension (along y axis) of the rectangular spiral should not exceed half of the length of the radiating slot segment (l). This constraint on the inductive rectangular spiral is imposed so that the entire antenna structure can fit into a square area of 55 mm×55 mm, which is about 0.05 $\lambda_0$×0.05 $\lambda_0$. Since the dielectric constant and the thickness of the substrate chosen for this design are very low ($\in_r$=2.2), the guided wavelength ($\lambda_g$=96 cm) is not very much different from that of free space ($\lambda_0$=100 cm). Thus, the miniaturization is mainly achieved by the proper choice of the antenna topology. It is worth mentioning that further size reduction can be obtained once a substrate with higher permittivity is used.

In the previous section, the transmission line model was employed for designing the proposed miniature antenna. Although this model is not very accurate, it provides the intuition necessary for designing the novel topology. The transmission line model ignores the coupling between the adjacent slot lines and the microstrip to slot transition. For calculation of the input impedance, and exact determination of the length of different slotline segments, a full-wave simulation tool is required. IE3D, a commercially available Moment Method code is used for required numerical simulations.

Figure 10:
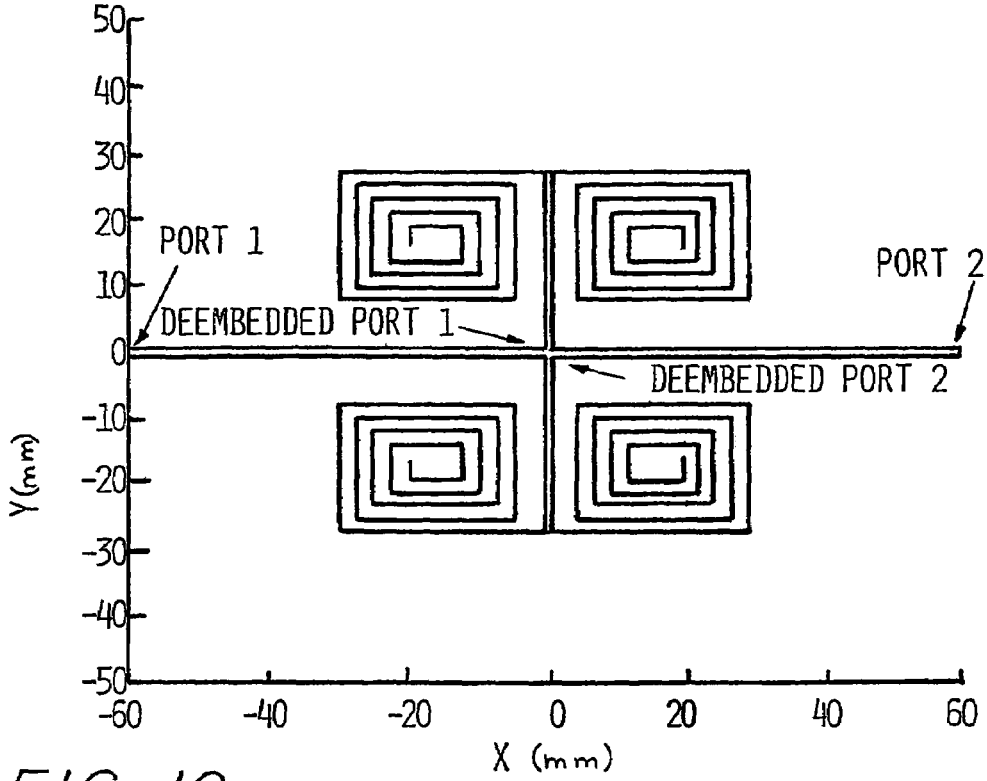
FIG. 10 is a simplified diagram illustrating an antennae geometry fed by a two-port microstrip feed to determine the exact resonant frequency of the inductively loaded slot.
Figure 11:
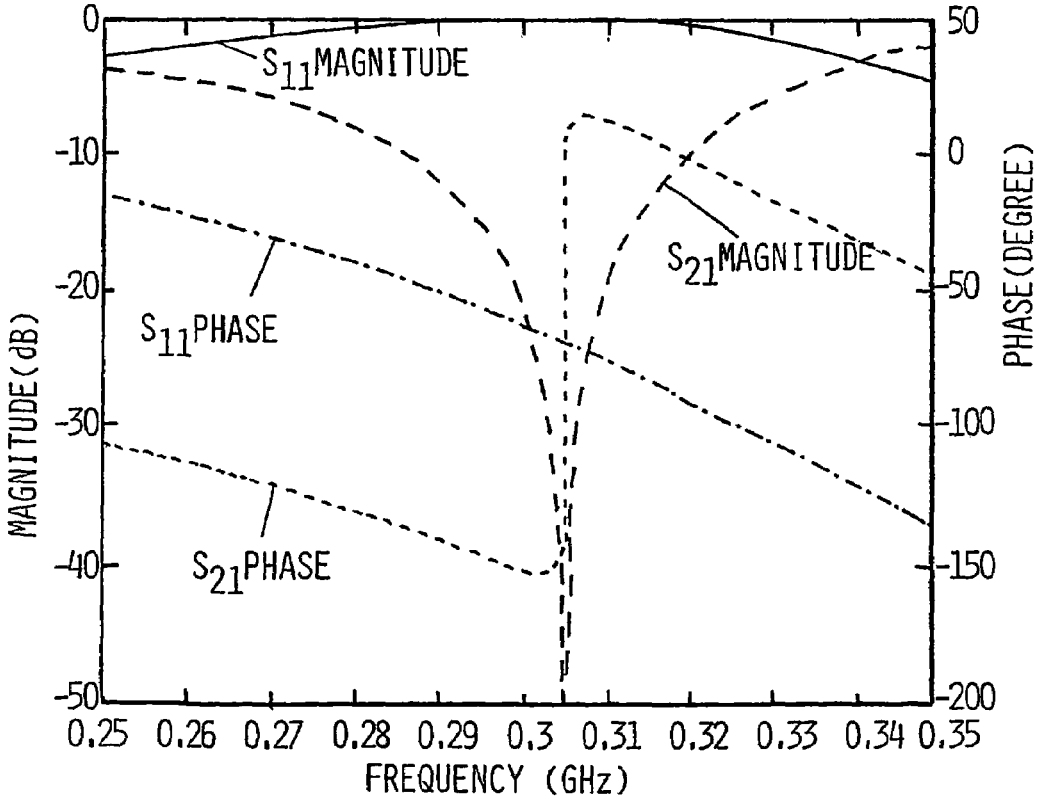
FIG. 11 is a graph illustrating the S-parameters of the two-port antennae illustrated in FIG. 19.
Figure 12:
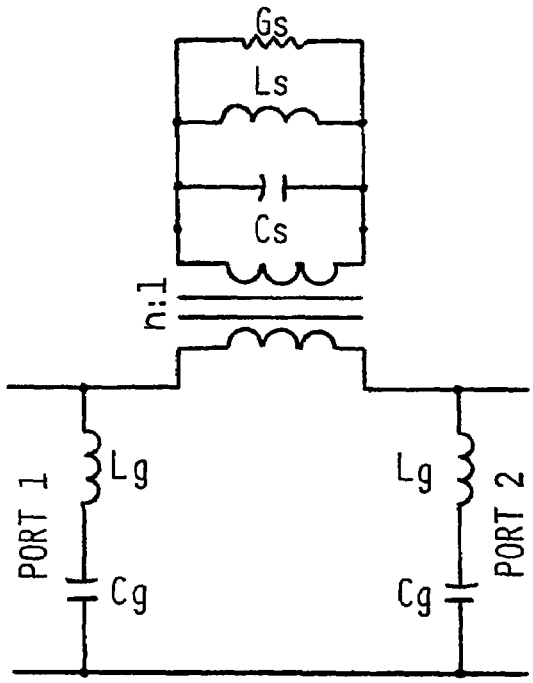
FIG. 12 is a simplified schematic view illustrating the topology of an equivalent circuit for the two-port antennae.

FIG. 10 shows the proposed antenna geometry fed by a two-port 50Ω microstrip line. The two-port structure is constructed to study the resonant frequency of the antenna as well as the transition between microstrip and the slot antenna. The microstrip line is extended well beyond the slot transition point so that the port terminals do not couple to the slot antenna. The radiating slot length is chosen to be l=55 mm, and the length of the rectangular spirals are tuned such that the antenna resonates at 300 MHz. The resonance at the desired frequency is indicated by a deep null in the frequency response of $S_{21}$. The simulated S-parameters of this two-port structure are shown in FIG. 11. This figure indicates that the antenna resonates at around 304 MHz, which is close to the desired frequency of 300 MHz. In fact, the resonant frequency of the radiating structure must be chosen at a slightly higher or lower frequency. The reason is that small slot antennas have a low radiation conductance at the first resonance and therefore, it should be tuned slightly off-resonance if it is to be matched to a 500 transmission line. FIG. 12 shows an equivalent circuit model for the two-port device when the transition between microstrip and slot line is represented by an ideal transformer with a frequency dependent turn ratio ($n^2$), and the slot is modeled by a second order shunt resonant circuit near its resonance.

The radiation conductance $G_s$, which is also referred to as the slot conductance, attains a low value that corresponds to a very high input impedance at the resonant frequency. However, this impedance would decrease considerably, when the frequency moves off the resonance. The 4 MHz offset in the resonant frequency of the antenna is maintained for this purpose.

Having tuned the resonant frequency of the antenna, coupled to the 2-port microstrip feed (FIG. 10), a loss-less impedance matching network must be designed. This can be accomplished by providing a proper impedance to terminate the second port of the microstrip feed line. To fulfill these tasks systematically, we need to extract the equivalent circuit parameters shown in FIG. 12. It should be pointed out that for the proposed miniaturized slot antenna, a simplistic model for normal size slots, which treats the slot antenna as an impedance in series with the microstrip line is not sufficient. Essentially, the parasitic effects caused by the coupling between the microstrip feed and rectangular spirals as well as the mutual coupling between the radiator section and the rectangular spirals should also be included in the equivalent circuit.

In this section, an equivalent circuit model for the proposed antenna is developed. This model is capable of predicting the slot radiation conductance and the antenna input impedance near resonance. This approach provides a very helpful insight as to how this antenna and its feed network operate. As mentioned before, this model is also needed to find a proper matching network for the antenna. Near resonant frequencies, the slot antenna can be modeled by a simple second order RLC circuit. Since the voltage across the slot excites the slot antenna at the feed point, it is appropriate to use the shunt resonant model for the radiating slot as shown in FIG. 12. The coupling between the microstrip and the slot is modeled by a series ideal transformer with a turn ratio n.

To model the feeding mechanism right at the cross junction of the microstrip and slot, it is necessary to de-embed the effect of the microstrip lines between the terminals and the crossing points. There are different de-embedding schemes reported in the literature. The advantage of proper de-embedding as opposed to the mere shifting of the reference planes by the corresponding phase factor is to exclude the effect of radiation and other parasitic effects of the line.

Figure 13:
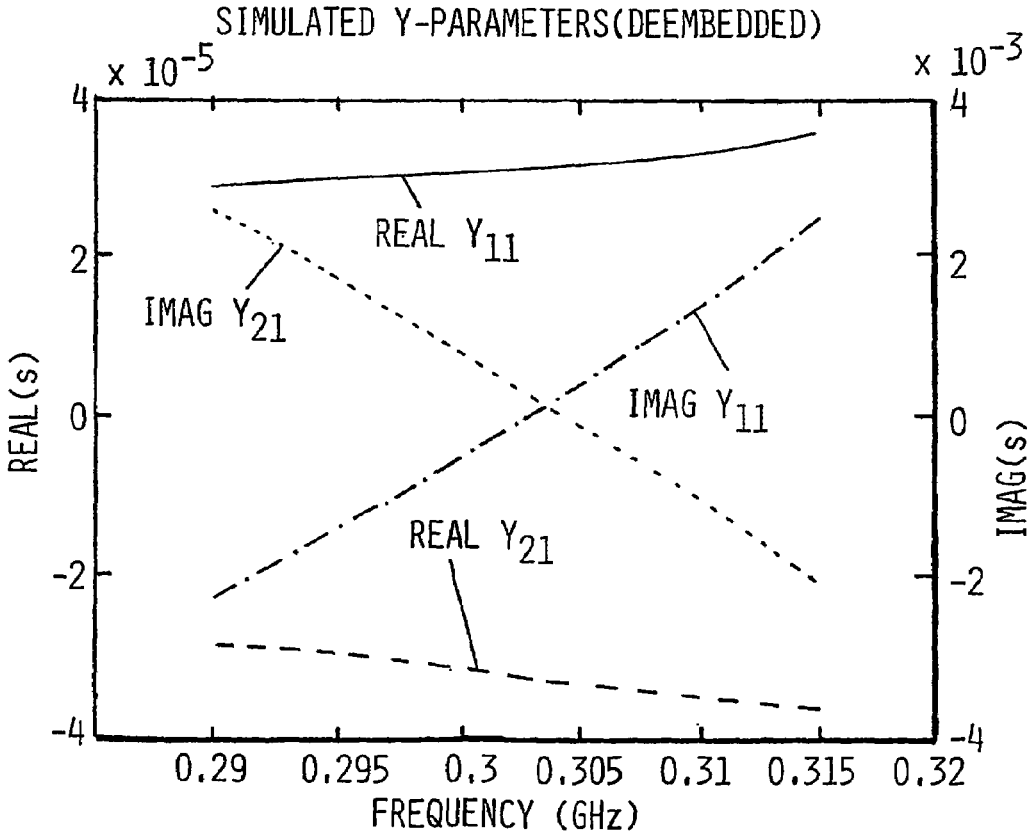
FIG. 13 is a graph illustrating the Y-parameters of the two-port antennae after de-embedding the microstrip feed lines.
Figure 14A:
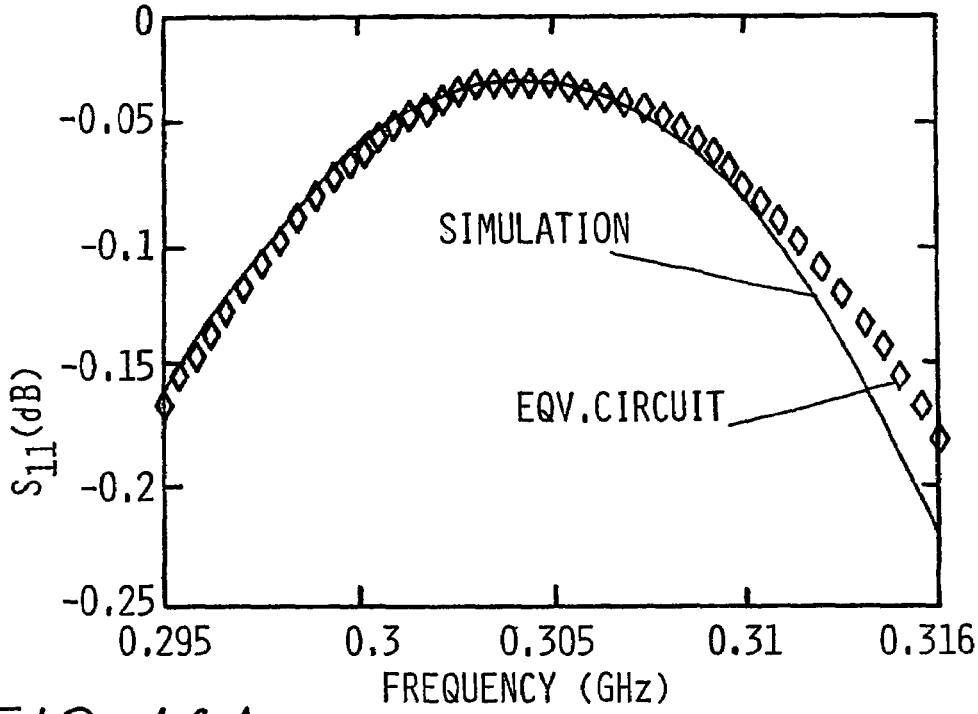
FIG. 14A through FIG. 14D illustrate comparisons between the full-wave simulated S-parameters of the antennae and that of the equivalent circuit.
Figure 14B:
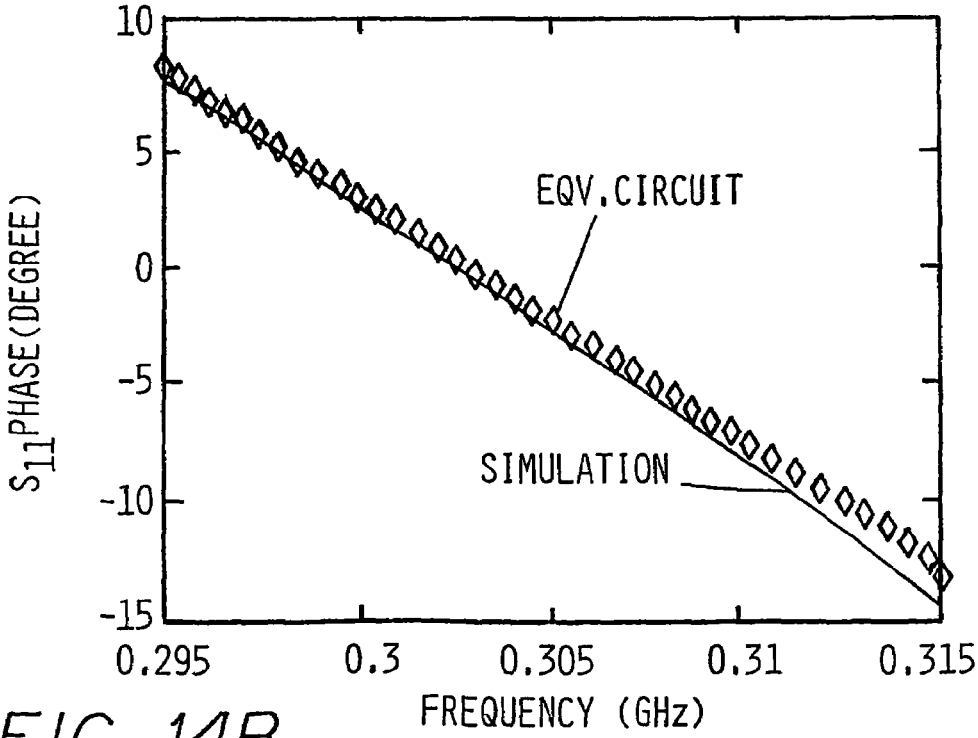
Figure 14C:
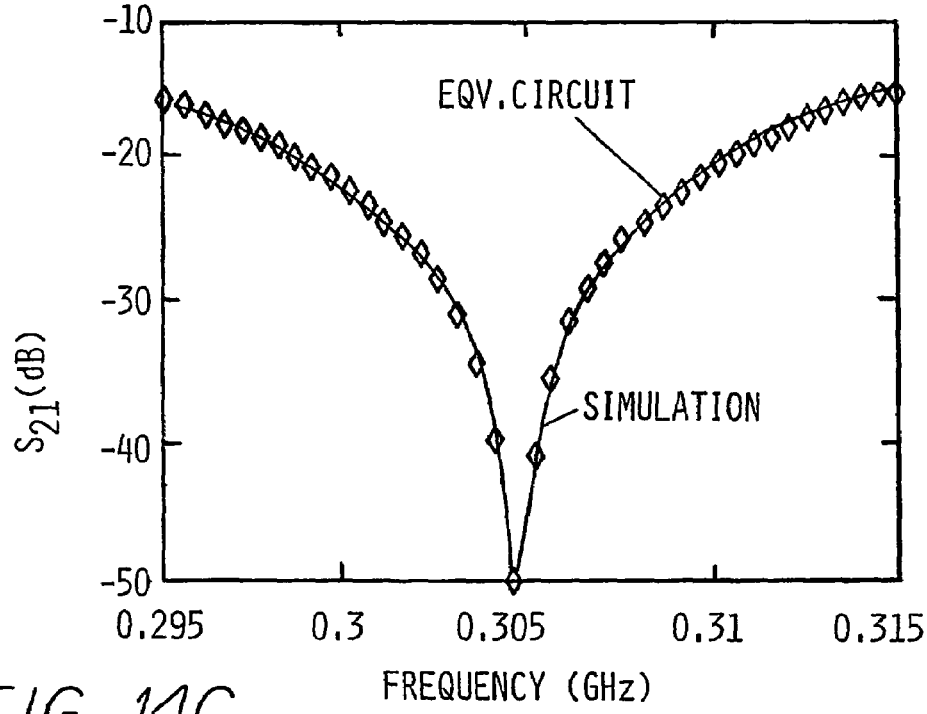
Figure 14D:
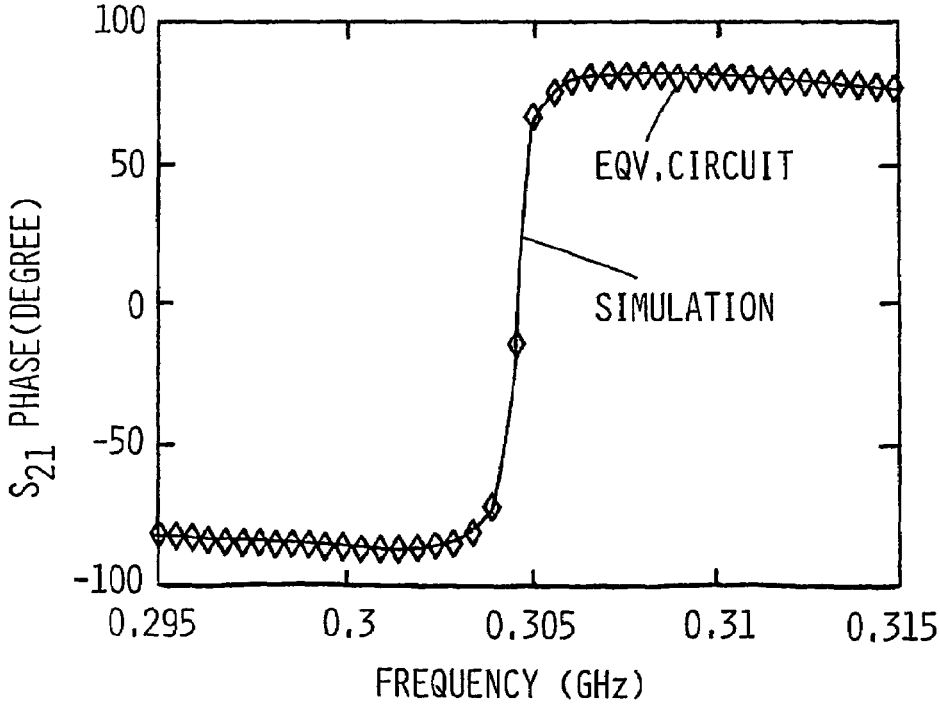

To model the parasitic coupling of the microstrip line and the slot (coupling of radiated field from the microstrip line and slot), two additional parasitic parameters, namely, $L_g$ and $C_g$ are included in the model The use of shunt parasitic parameter has previously been suggested to model the effects of fields as perturbed by a wide slot. FIG. 13 shows the de-embedded Y-parameters of the two-port microstrip-fed slot antenna where the location of de-embedded ports are shown in FIG. 10. Note that these two ports are now defined at the microstrip-slot junction According to the lumped element model of FIG. 12, the Y-parameters are given by:

$$Y_{11} = \frac{-j}{L_g\omega - \frac{1}{C_{g\omega}}} + \frac{1}{n^2}\left[G_s + j\left(C_s\omega - \frac{1}{L_s\omega}\right)\right] \tag{5}$$

$$Y_{21} = -\frac{1}{n^2}\left[G_s + j\left(C_s\omega - \frac{1}{L_s\omega}\right)\right] \tag{6}$$

Using reciprocity and noting the symmetry of the equivalent circuit, it can easily be shown that $Y_{11}=Y_{22}$ and $Y_{21}=Y_{12}$.

In order to extract the equivalent circuit parameters, a Genetic Algorithm (GA) optimization code has been developed and implemented. The sum of the squares of relative error for real and imaginary parts of Y-parameters over 40 frequency points around the resonance is used as the objective (fitness) function of the optimization problem. The program can be run with different random number seeds to ensure the best result over the entire domain of the parameters space. Also, the parameters were constrained only to physical values in the region of interest. The parameters of the GA optimizer are shown in Table 3. Table 4 shows the extracted equivalent circuit parameters after fifty thousands iterations.

TABLE 3

The parameters of the Genetic Algorithm optimizer.

| | |
|---|---|
| Population Size | 300 |
| Number of Iteration | 50,000 |
| Chromosome Length | 128 |
| $P_{Crossover}$ | 0.55 |
| $P_{Mutation}$ | 0.005 |

The S-parameters of the equivalent circuit as well as the S-parameters extracted from the full-wave analysis are shown in FIGS. 14A, 14B, 14C, and 14D. Excellent agreement is observed between the full-wave results and those of the equivalent circuit.

TABLE 4

The equivalent circuit parameters of the microstrip fed slot antenna.

| | |
|---|---|
| Turn Ratio (n) | 0.948007 |
| $R_s$ (Ω) | 33979 |
| $L_s$ (μH) | 0.0207 |
| $C_s$ (pF) | 13.1744 |
| $L_g$ (μH) | 0.49997 |
| $C_g$ (pF) | 0.125 |

Having found the equivalent circuit parameters, the antenna's matching network can readily be designed. For matching networks, especially when the efficiency is the main concern, loss-less terminations are usually desired. Therefore, a purely reactive admittance is sought to terminate the feed line, which in fact is the load for the second port of the two-port equivalent circuit model. The explicit expression for a termination admittance ($Y_t$) to be placed at the second terminal of the two-port model in order to match the impedance of the antenna is given by:

$$Y_t = -Y_{11} + \frac{Y_{12}^2}{Y_{11} - Y_0} \tag{7}$$

Figure 15:
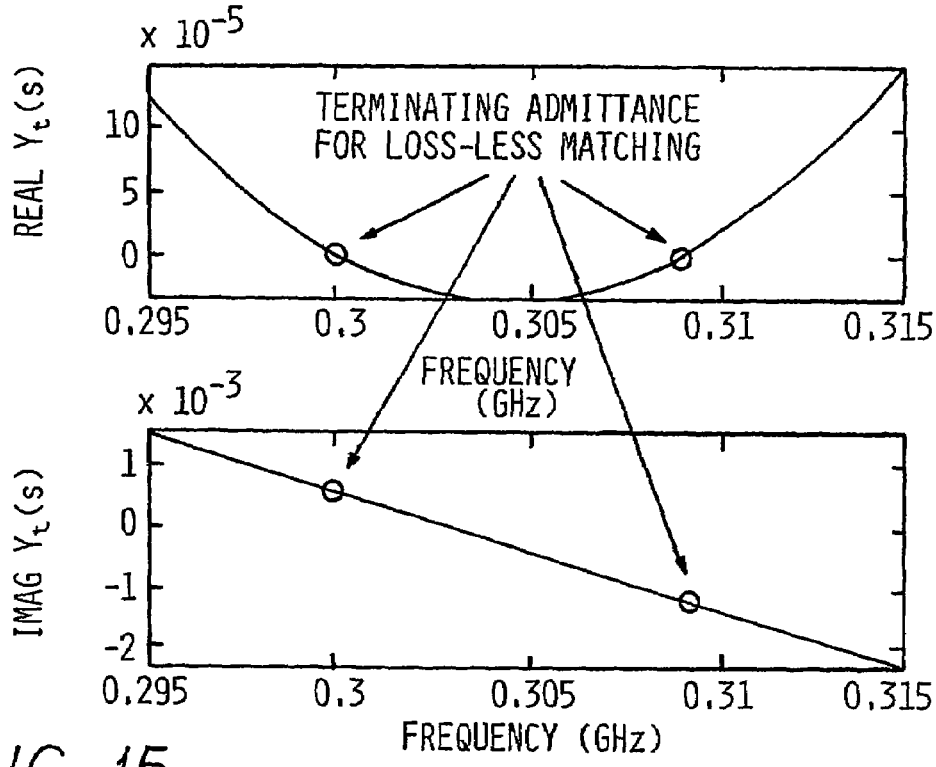
FIG. 15 is a graph illustrating the required terminating admittance for the second port of the two-port model in order to match the antennae to a 50Ω line.

FIG. 15 shows the spectral behavior of $Y_t$ for a standard 50Ω line ($Y_0$=0.02℧). Interesting to note are the two distinct frequency points at which the real part of $Y_t$ vanishes. This implies that this antenna can be matched at these two frequency points, namely, 300 MHz and 309 MHz. As mentioned earlier, a small slot antenna has a very low radiation conductance.

The value of this low conductance, as can be found in Table 4 suggests a very high input impedance of the order of 30 KΩ at resonance, considering the transformer turn ratio. Thus, in order to match the antenna to a lower impedance transmission line, the matching should be done at a frequency slightly off the resonance. At an off-resonance frequency, the input impedance does not remain a pure real quantity, however, the imaginary part can easily be compensated for by an additional reactive component created by an open-ended microstrip. At each resonance, there are two possibilities. One possibility is to match the antenna slightly below the slot resonance, that is 304 MHz (FIG. 11), and terminate the second port capacitively. The second possibility is to tune the antenna slightly above the slot resonance and terminate the second port inductively.

TABLE 5

The physical length of the 50Ω microstrip line needed for realizing the termination susceptance, where the dielectric material properties are as specified in Table 2.

| f (MHZ) | 300 | 309 |
|---|---|---|
| $Y_t(s)$ | $j5.4 \times 10^{-4}$ | $-j1.14 \times 10^{-3}$ |
| $\lambda_g$(mm) | 725.57 | 704.52 |
| $Z_0(\Omega)$ | 50 | 50 |
| Line extension (mm) | 3.1514 | 345.80 |

Based on what is shown in Table 5, a very short open-ended-microstrip line extension is required at the second port, in contrast with a quarter wavelength extension for an ordinary half wavelength slot antenna This short extension introduces a small capacitance, which compensates the additional inductance introduced as a result of operating below resonance. After tuning the antenna, the original slot resonant frequency at 304 MHz, shifts down to the desired frequency of 300 MHz, as shown in FIG. 15 and Table 5.

EXAMPLE III

Figure 17:
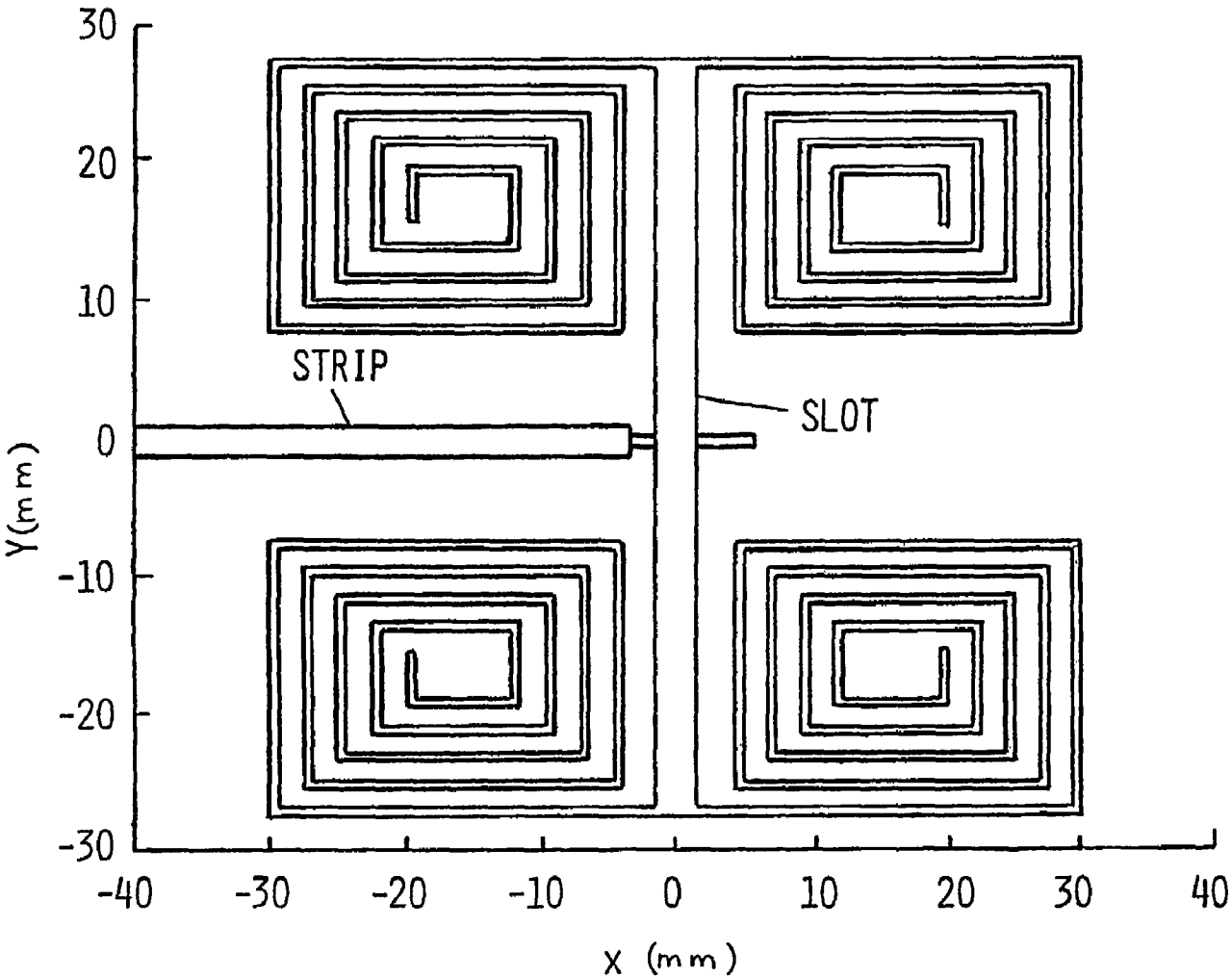
FIG. 17 is a simplified schematic view illustrating the geometry of a slot antennae and feed.

In this section, simulation results for the antenna according to the present invention are illustrated. FIG. 17 shows the antenna geometry matched to a 50Ω line. As seen in FIG. 17 and suggested by Table 5, the feed line has been extended a short distance beyond the slot line. The width of the microstrip where it crosses the slot is reduced so that it may block a smaller portion of the radiating slot. It is worth mentioning that the effect of the feed line width on its coupling to the slot was investigated, and it was found that as long as the line width is much smaller than the radiating slot length, the equivalent circuit parameters do not change considerably.

As mentioned, the antenna has been simulated using a commercial software (IE3D). Using this software, the return loss ($S_{11}$) of the antenna is calculated and shown in FIG. 16. In order to experimentally validate the design procedure, equivalent circuit model and simulation results, the antenna was fabricated on a 0.787 mm-thick substrate with $\in_r$=2.2 and tan δ=0.001.

Figure 16:
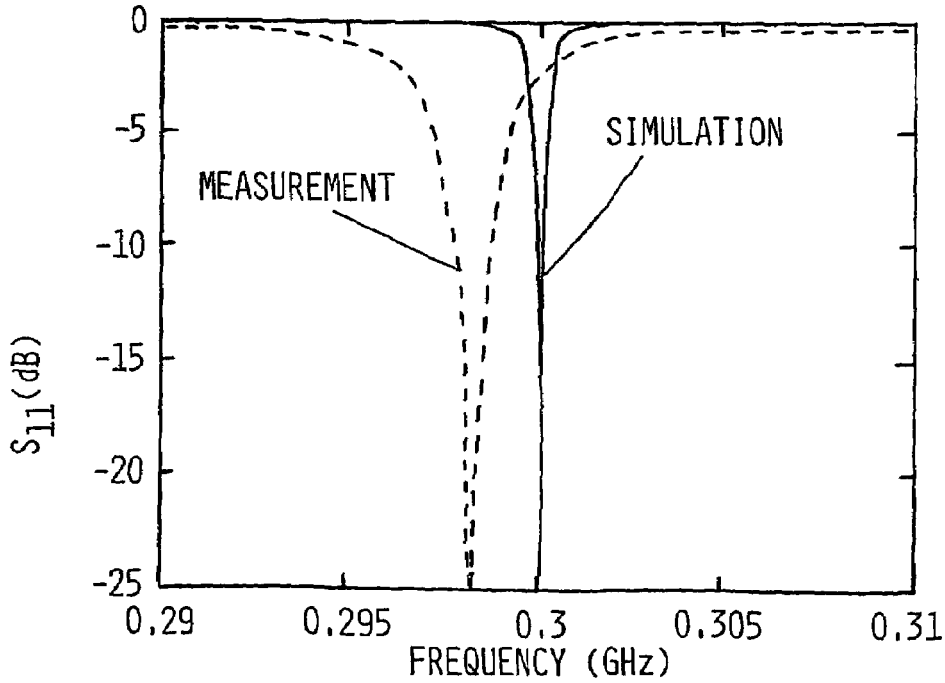
FIG. 16 is a graph illustrating measured and simulated return loss of the miniaturized antennae.
Figure 18:
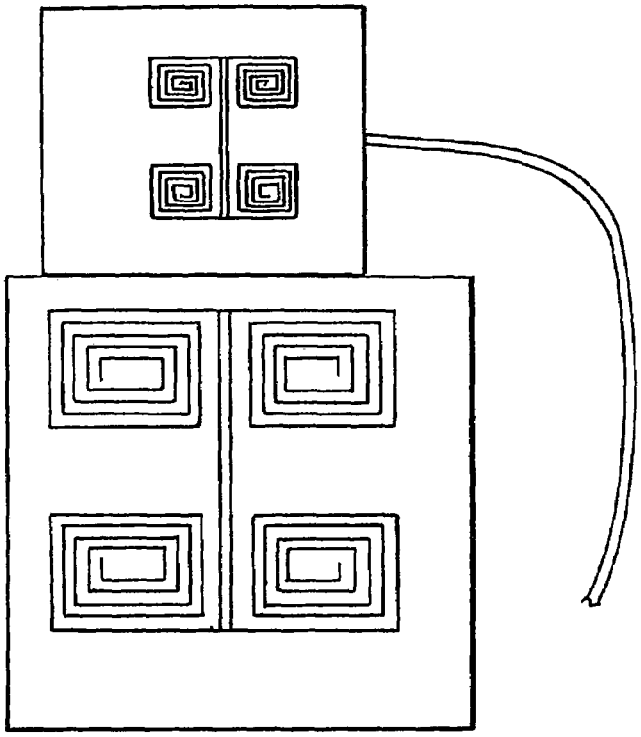
FIG. 18 is a photograph of a fabricated antennae according to the present invention.

FIG. 18 shows a photograph of the fabricated antenna. The return loss ($S_{11}$) of the antenna was measured using a calibrated vector network analyzer and the result is shown in FIG. 16. The measured results show a slight shift in the resonant frequency of the antenna (≈1%) from what is predicted by the numerical code. The errors associated with the numerical code could contribute to this frequency shift. This deviation can also be attributed to the finite size of the ground plane, 0.21 $\lambda_0$×0.18 $\lambda_0$ for this prototype, knowing that an infinite ground plane is assumed in the numerical simulation.

The far field radiation patterns of the antenna were measured in the anechoic chamber of The University of Michigan. The gain of the antenna was measured at the bore-sight direction under polarization-matched condition using a standard antenna whose gain is known as a function of frequency. The gain of −3 dB, (relative to an isotropic radiator) was measured. Having perfectly matched the impedance of the antenna, the simulated efficiency of this antenna is found to be η=67% (−1.75 dB), which can exclusively be attributed to Ohmic and dielectric losses. The simulated radiation efficiency is the ratio of the total radiated power to the input power of the antenna. The directivity of this antenna (with infinite ground plane) was computed to be D=2.0 dB. This value of directivity is very close to that of a dipole antenna. Based on the definition of the antenna gain, under the impedance matched condition, one might expect to measure the maximum gain of $$G=\eta\cdot D=-1.75\text{ dB}+2.5\text{ dB}=0.75\text{ dB}. \quad (8)$$

for this antenna. There is still a considerable difference between the measured and simulated gains (about 3.75 dB), which stems from two major factors. First, in the simulation, an infinite ground plane is assumed, whereas the actual ground plane size for the measured antenna is approximately 0.2 $\lambda_0$×0.24 $\lambda_0$. As the ground plane size decreases, the level of electric current around the edges increases considerably. This increase in the level of the electric current results in an additional Ohmic loss compared to the infinite ground plane. Another reason is that as the ground plane size decreases, the directivity of the slot antenna is reduced. Basically, as the ground plane becomes smaller, the null in the pattern diminishes and the pattern approaches that of an isotropic radiator. The reduction in the directivity of the slot antenna with a finite ground plane can also be attributed to the radiation from the edges and surface wave diffraction. To further study the effect of the size of the ground plane, the same antenna with a slightly larger ground plane (0.58 $\lambda_0$×0.43 $\lambda_0$) was fabricated and measured. Table 6 shows the comparison between the radiation characteristics of these two antennas and simulated results. As explained, when the size of the antenna ground plane increases, the gain of the antenna increases from −3.0 $dB_i$ to 0.6 $dB_i$, which is almost equal to the gain of a half wavelength dipole and very close to the simulated value for the antenna gain.

TABLE 6

Antenna characteristics as a function of two different size ground planes compared with the simulated results for the same antenna on an infinite ground plane.

| Ground-Plane size [cm] | Resonant frequency [MHZ] | Return Loss [dB] | Antenna Gain [$dB_i$] |
|---|---|---|---|
| 21 × 18 | 298.1 | −27 | −3.0 |
| 58 × 43 | 298.8 | −30 | 0.6 |
| simulation(∞) | 300 | <−30 | 0.75 |

Figure 19:
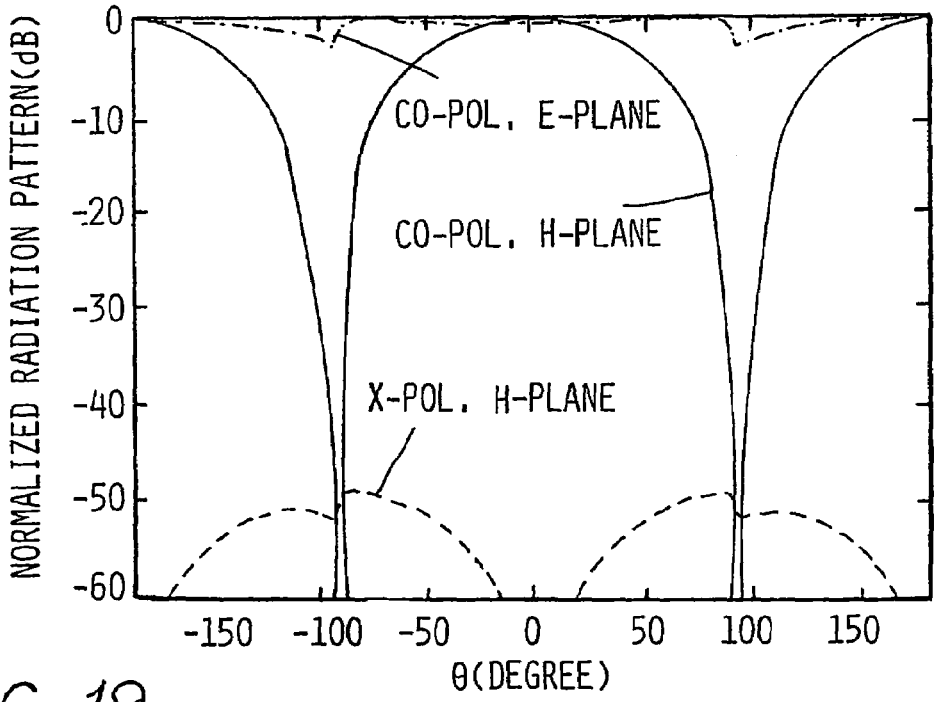
FIG. 19 is a graph illustrating the simulated radiation pattern of the miniaturized antennae.
Figure 20A:
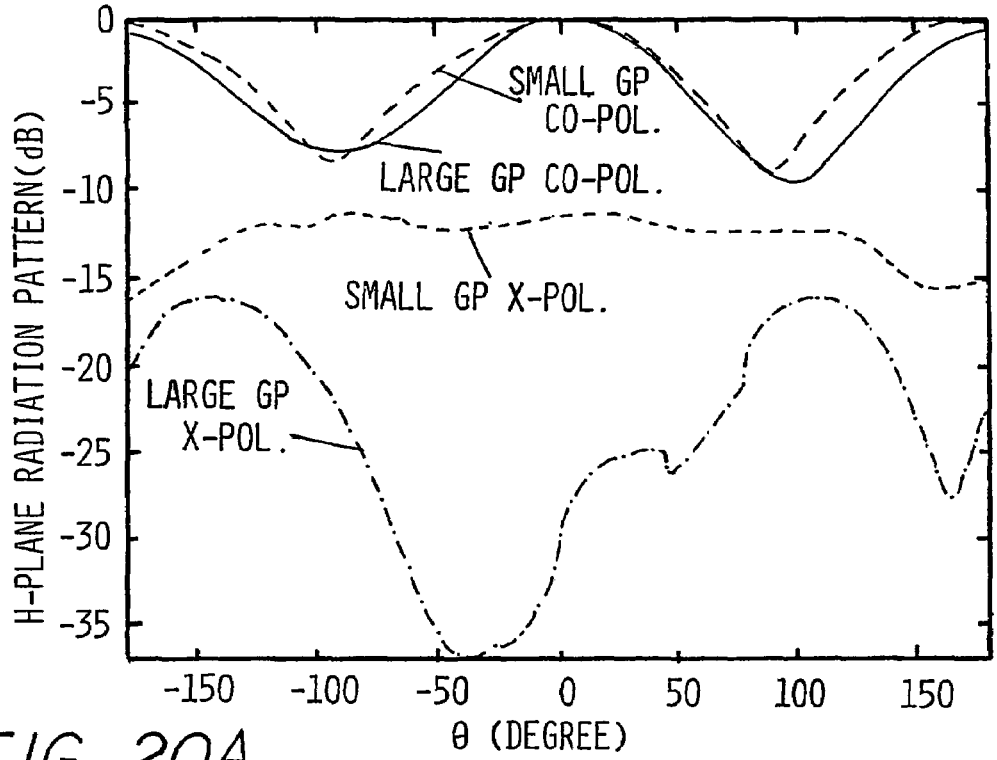
FIG. 20A is a graph illustrating the measured radiation pattern of the antennae with a ($0.2\ \lambda_0 \times 0.2\ \lambda_0$) and a larger ($0.5\ \lambda_0 \times 0.5\ \lambda_0$) ground plane illustrating the H-plane pattern.
Figure 20B:
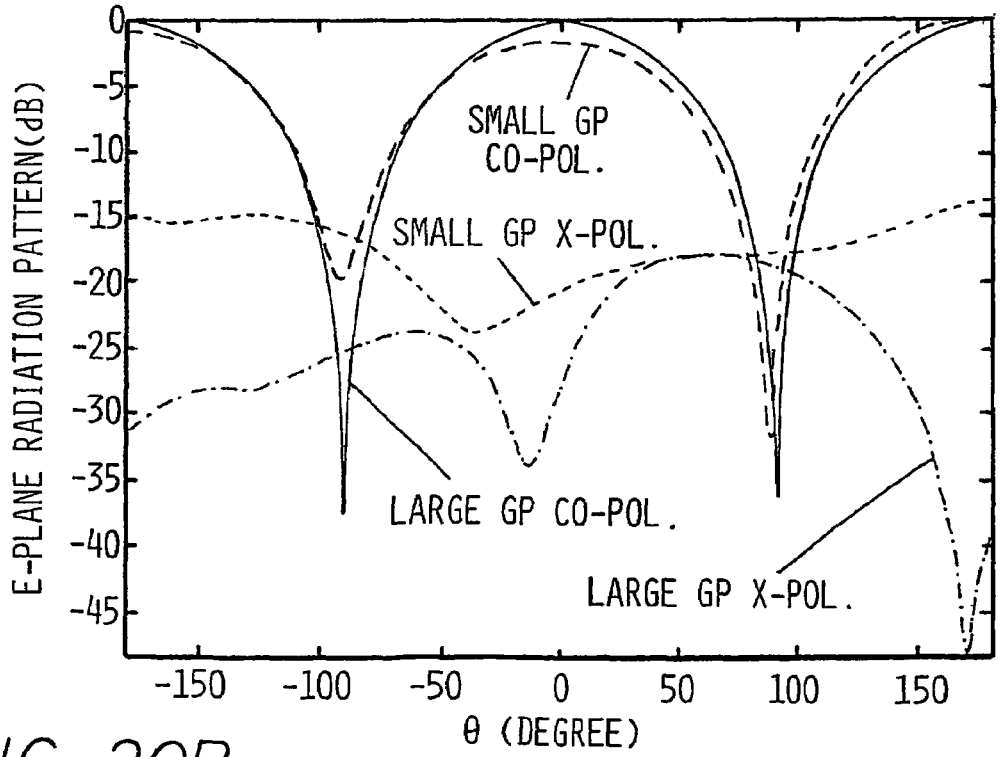
FIG. 20B is a measured radiation pattern of the antennae of FIG. 28A illustrating the E-plane pattern.

Finally, the radiation patterns of the proposed antenna in the principal E- and H-plane were measured and compared with the theoretical ones. For H-plane pattern, $E_\phi(\theta)$ in the $\phi$=90° plane was measured, and for B-plane pattern, $E_\theta(\theta)$ was measured in the $\phi$=0°. The simulated radiation patterns of this antenna are shown in FIG. 19. It is seen that the simulated radiation patterns of the proposed antenna with an infinite ground plane is almost the same as that of an infinitesimal slot dipole. FIGS. 20A and 20B show the normalized co- and cross-polarized radiation patterns of the H- and E-plane, respectively, for two different ground planes. As expected, the null in the H-plane radiation pattern is filled considerably owing to the finite ground plane size. The ground plane enforces the tangential E-field, $E_\phi(\theta)$, to vanish along the radiating slot at θ=90°, which in fact creates the null in the H-plane pattern. On the other hand, a deep null in the measured E-plane pattern is observed, whereas in simulation this cut of the pattern is constant except at the dielectric-air interface where the normal E-field is discontinuous. This null in the E-plane is the result of the cancellation of fields, which are radiated by the two opposing magnetic currents. The equivalent magnetic currents, flowing in the upper and lower side of the ground plane, are in opposite directions and consequently, their radiation in the point of symmetry at the E-plane cancel each other. However, in the case of an infinite ground plane, the upper and lower half-spaces are isolated and therefore, the E-plane radiation pattern remains constant.

Moreover, an increase in the measured cross-polarized component is observed as compared with the simulation results. Although it may seem that there is a considerable cross polarization radiation due to the presence of spiral slots at the terminations, there is no such component in the principal planes as well as the $\phi=\pm 45°$ planes since the geometry is symmetric with respect to those planes. The cross polarization appearing in these measurements is mainly caused by radiation from the edges as well as the feed cable.

The contribution of the anechoic chamber, giving rise to the cross-polarized component at the low frequency of 300 MHz is also a factor. The radiated field of the antenna is always capable of inducing currents on the feeding cable, especially when the ground plane size is very small compared to the wavelength. Then, the induced currents re-radiate and give rise to the cross polarization. Nevertheless, both of the above mentioned sources for the cross-polarization can be eliminated by increasing the ground plane size.

A procedure for designing a new class of miniaturized slot antennas according to the present invention has been disclosed. In this design the area occupied by the antenna can be chosen arbitrarily small, depending on the applications at hand and the trade-off between the antenna size and the required bandwidth. As an example, an antenna with the dimensions $0.05\ \lambda_0 \times 0.05\ \lambda_0$ was designed at 300 MHz and perfectly matched to a 50Ω transmission line. In this prototype, a substrate with a low dielectric constant of $\in_r=2.2$ was used to ensure that the dielectric material would not contribute to the antenna miniaturization. An equivalent circuit for the antenna was developed, which provided the guidelines necessary for designing a compact loss-less matching network for the antenna. To validate the design procedure, a prototype antenna was fabricated and measured at 300 MHz. A perfect match for this very small antenna was demonstrated with a moderate gain of −3.0 $dB_i$ when the antenna is fabricated on a very small ground plane with the approximate dimensions of $0.2\ \lambda_0 \times 0.2\ \lambda_0$. The gain of this antenna can increase to that of a half-wave dipole when a slightly larger ground plane of about $0.5\ \lambda_0 \times 0.5\ \lambda_0$ is used. The fractional bandwidth for this antenna was measured to be 0.4%.

Figure 21:
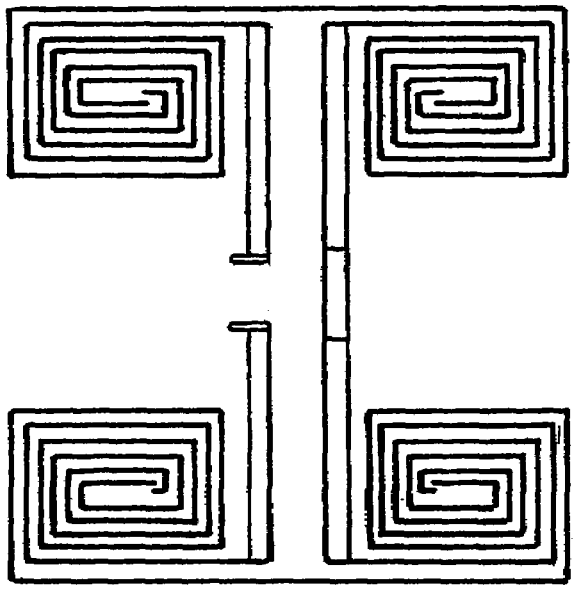
FIG. 21 is a simplified schematic view of a miniaturized folded slot antennae.
Figure 22A:
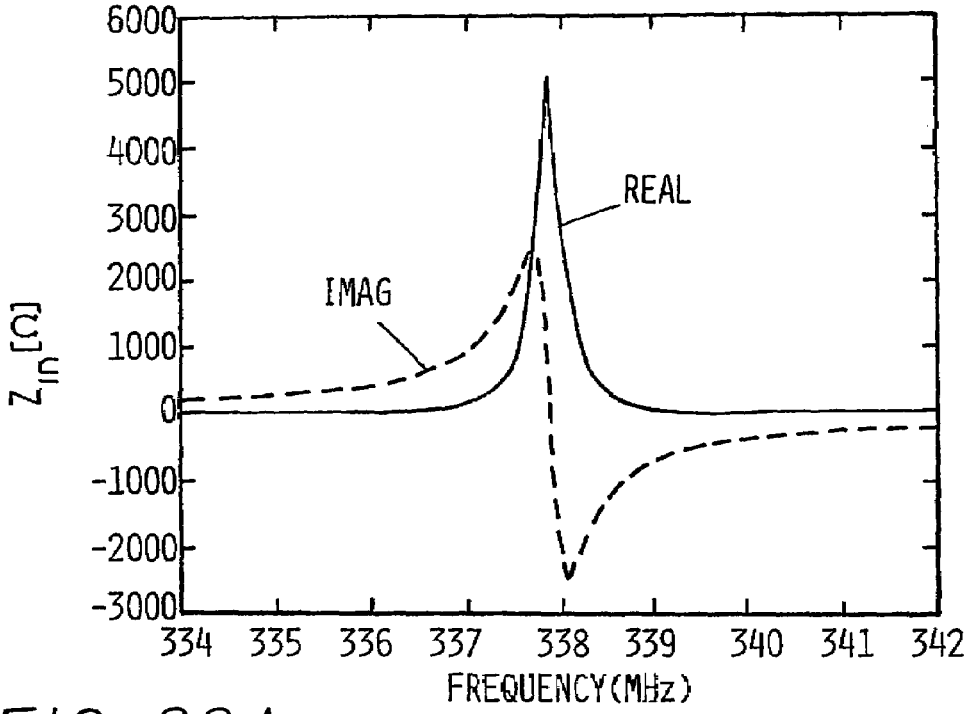
FIG. 22A is a graph illustrating impedance of a center fed miniaturized folded-slot antennae.
Figure 22B:
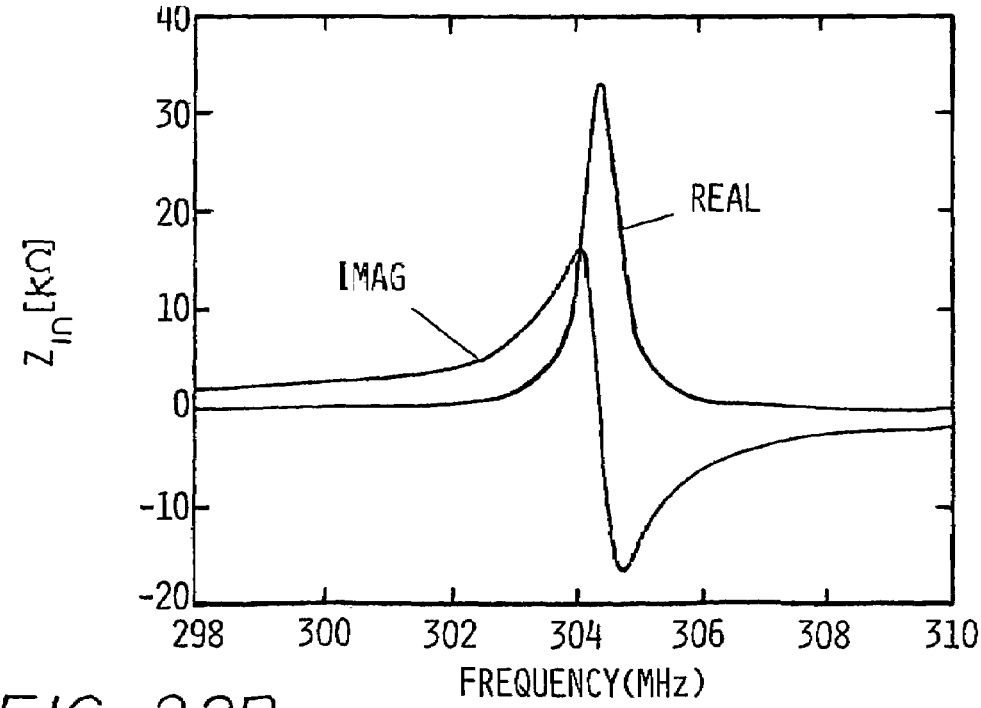
FIG. 22B is a graph illustrating impedance of a miniature slot antennae for comparison with FIG. 12A.
Figure 23:
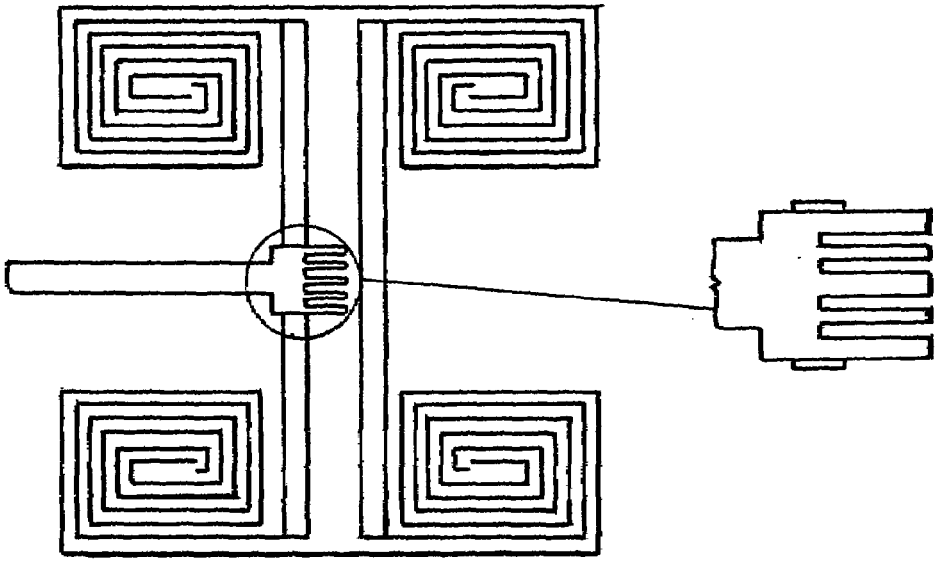
FIG. 23 is a simplified schematic diagram of a capacitively fed miniaturized folded slot antennae geometry.

A new miniaturized antenna structure according to the present invention is disclosed with a larger radiation conductance (physical aperture), bandwidth, and efficiency, while maintaining the size of the antenna. Conversely, maintaining the bandwidth and efficiency, this structure can be further miniaturized ($0.03\ \lambda_0 \times 0.03\ \lambda_0$). The structure according to the present invention is based on a folded slot design whose geometry is shown in FIG. 21. The physical aperture of the miniaturized folded slot is twice as large as that of the miniaturized slot illustrated in FIG. 1A, and therefore, should demonstrate a radiation conductance four times as high as the design of FIG. 1A In order to specify the resonant frequency and radiation resistance of the folded-slot structure, the antenna was center-fed with a CPW line and was simulated using a commercially available Moment Method code. FIGS. 22A and 22B show a comparison between the input impedance of the folded design, and the single slot of FIG. 1A, where it can be seen that the impedance of the folded slot antenna is reduced by a factor of four, relative to that of the narrow slot design. Therefore, a much smaller reactance is needed to match the impedance to a 50Ω line. In fact, the closer the impedance of the antenna is to 50Ω, the easier it is to match, and the wider the frequency band over which impedance matching can be expected. There are two choices to achieve impedance match: one is to tune it below resonance where the slot is inductive and then, compensate that inductance with a capacitive coupling at the feed, and the other is to inductively feed the slot slightly above its resonance. Since it is desirable to minimize the antenna size, a capacitively fed slot antenna is preferred. FIG. 23 shows the miniaturized folded slot antenna matched to a 50Ω CPW line. The proper value of the capacitance to be inserted in the feed is determined from a second order resonant equivalent circuit model. These model parameters can be extracted using a full wave simulation of the antenna structure. The folded slot has a resonance at 337.9 MHZ with a radiation resistance of about 5 K Ω, as shown in FIG. 22A. After insertion of a tuning capacitance, the antenna is matched to 50Ω at a slightly lower frequency of 336.1 MHZ. (See FIG. 24).

EXAMPLE IV

Figure 24:
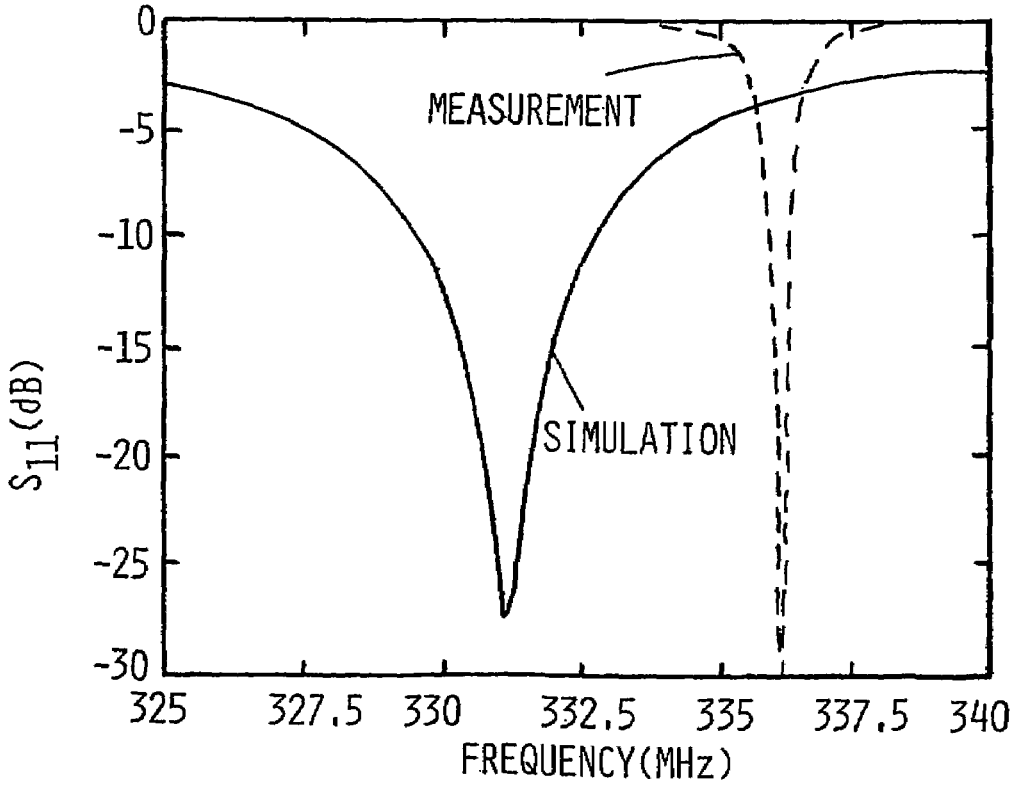
FIG. 24 is a graph illustrating measurement and simulation of a miniaturized folded slot antennae return loss.

The miniaturized folded slot shown in FIG. 23., was fabricated on a 0.762 mm thick RT Duroid 5880 and its impedance and radiation characteristics were investigated in order to validate simulation results. The simulated and measured return losses for the folded antenna are shown in FIG. 24, where it is shown that a perfect impedance match is achieved. There is a %1 shift in the resonant frequency of the matched antenna compared to the results obtained from the simulation. This discrepancy can be attributed to the finite size of the ground-plane, numerical error, and the underestimation of the dielectric loss tangent of the substrate. FIG. 16 shows the same data sets for a miniaturized single slot antenna, having approximately the same size. Comparison of FIGS. 24 and 16, clearly indicates an increase in the −10 dB return-loss bandwidth of the antenna. Table 7, shows a comparison between both simulated and measured bandwidths of these two antennas.

TABLE 7

Comparison between miniaturized slot and miniaturized folded slot antennas.

| Antenna | | BW (%) | | Gain (dBi) | | Directivity |
|---|---|---|---|---|---|---|
| Type | Size | Sim | meas | Sim | meas | (dB) |
| Miniature slot | $0.05\lambda_0 \times 0.05\lambda_0$ | 0.058 | 0.34 | 1.0 | −3.0 | 1.9 |
| Folded slot | $0.067\lambda_0 \times 0.067\lambda_0$ | 0.12 | 0.93 | 1.0 | −2.7 | 1.8 |

Figure 26:
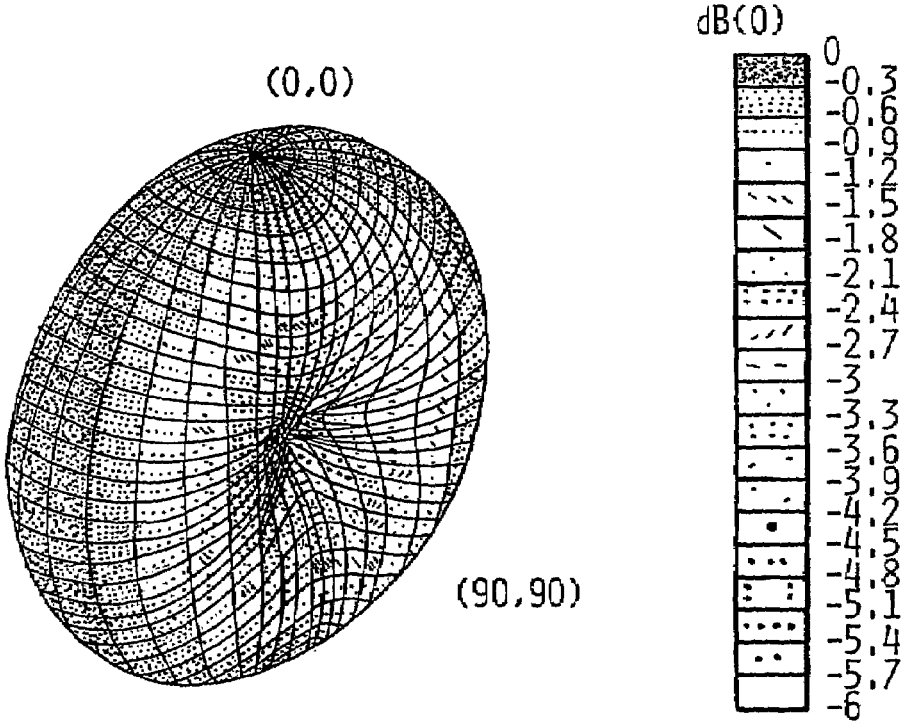
FIG. 26 is a simulated radiation pattern of the total field for the miniaturized folded slot antennae.
Figure 25A:
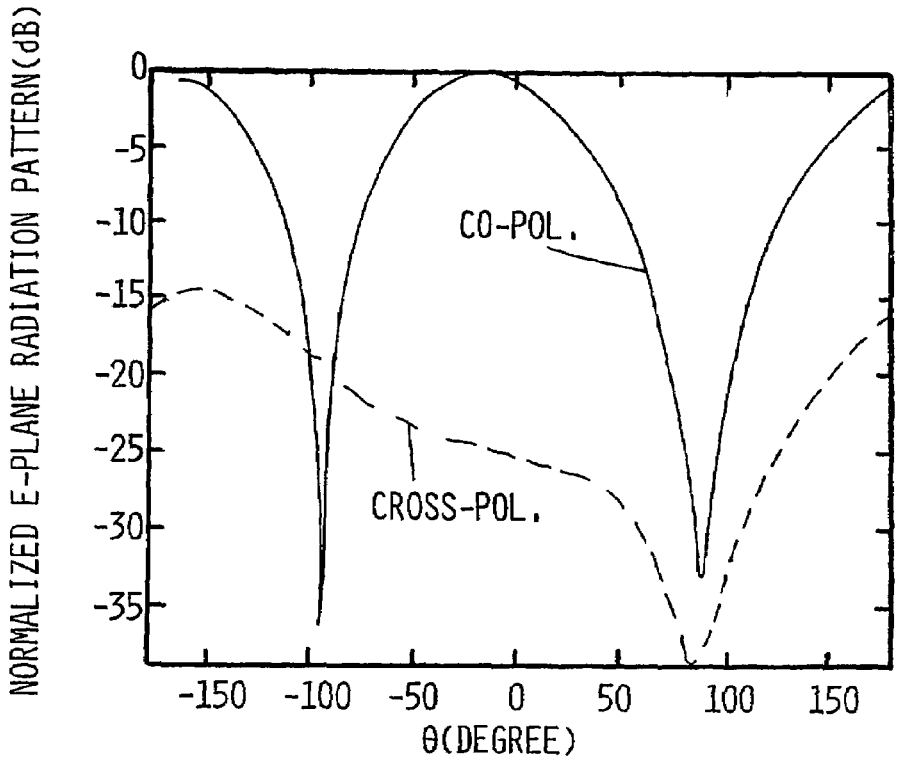
FIG. 25A is a graph illustrating radiation pattern for the miniaturized folded slot antennae in the E-plane.
Figure 25B:
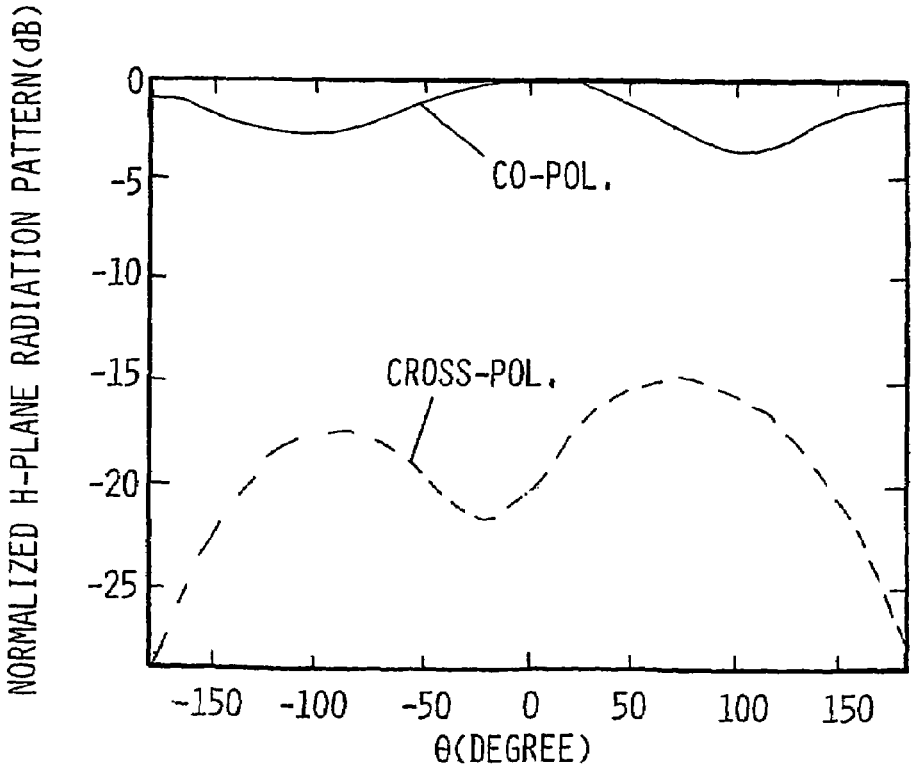
FIG. 25B is a graph illustrating the radiation pattern for the miniaturized folded slot antennae in the H-plane.

It should be pointed out that there is a considerable difference between the simulated and measured bandwidths. This variation stems from the fact that some losses are not accounted for in the simulation, including the increased conduction loss generated by the edge currents around the edges of the ground plane and also the radiation from edges of the substrate. The gain of this antenna was determined with reference to a standard half wavelength dipole antenna. A gain of −2.7 dB over the gain of a standard λ/2 dipole was measured. The gain of a standard dipole is assumed to be 0 dBi. This measured value is lower than the simulated results, which again can be attributed to the finite size of the ground plane. As the size of ground plane is increased, the measured results converge to that of the simulation. Finally, the E-plane and H-plane radiation patterns of the antenna were measured in the anechoic chamber and the results are shown in FIGS. 25A and 25B. FIG. 26 depicts the simulated radiation pattern of the total field and shows that this structure has a pattern very similar to that of a small dipole. The cross polarization components are negligible in the principal planes. The observed cross-polarized radiation is believed to emanate from feeding cables rather than from the antenna itself A miniaturized folded slot antenna according to the present invention presents an improved configuration for miniaturized slot antennas, which demonstrates wider bandwidth and higher radiation efficiency. By fixing the size of the configuration to 0.06 $\lambda_0 \times 0.06\ \lambda_0$, which is almost the same as dimensions of the miniaturized slot antenna, the bandwidth of the antenna was increased by 100% with a slight increase in the gain of the antenna.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A miniaturized antenna for sending and receiving a signal having a wavelength comprising:

a substrate; and a slot dipole line formed on the substrate with an electrical length less than a quarter wavelength and a short circuit at one end and an open circuit at an opposite end, the slot dipole line having a radiating section with three line portions bent with respect to one another, where one line portion has a width less than a width of other line portions.

2. The antenna of claim 1 further comprising:

the open circuit of the slot dipole line including two non-radiating spiral slots formed as symmetrical mirror images of one another and short circuited at one end.

3. The antenna of claim 2 further comprising:

the two non-radiating spiral slots having less than a quarter wavelength.

4. The antenna of claim 1 further comprising:

a bent radiating section of the slot line.

5. The antenna of claim 4 further comprising:

the bent radiating section having at least two portions extending angularly with respect to one another so that no portion carries a magnetic current opposing a magnetic current of any other portion.

6. The antenna of claim 1 further comprising:

an open ended microstrip line feeding the slot dipole line of the antenna at a crossing point and extending less than a quarter wavelength.

7. The antenna of claim 1 further comprising:

relative lengths of each line portion selected to minimize an area occupied by the slot line.

8. The antenna of claim 1 further comprising:

wherein the antenna is operably coupled with respect to a mobile apparatus selected from a group including an electronic chip, a laptop computer, a body of a motor vehicle, a mirror of a motor vehicle, an aircraft body component, and a missile body component.

9. The antenna of claim 1 further comprising:

the substrate being planar and low profile with a relatively thin thickness and having dimensions of length and width less than one-half the wavelength to be sent and received.

10. The antenna of claim 1 further comprising:

the antenna being monolithic, integrated, and resonant.

11. A miniaturized antenna for sending and receiving a signal having a wavelength comprising:

a substrate;

a slot dipole line formed on the substrate with an electrical length less than a quarter wavelength and a short circuit at one end and an open circuit at an opposite end;

a bent radiating section of the slot line, the bent radiating section having at least two portions extending angularly with respect to one another so that no portion carries a magnetic current opposing a magnetic current of any other portion; and a T-shaped end formed on the radiating section.

12. A miniaturized antenna for sending and receiving a signal having a wavelength comprising:

a substrate;

a slot dipole line formed on the substrate with an electrical length less than a quarter wavelength and a short circuit at one end and an open circuit at an opposite end; and two inductive short-circuited spiral slot lines terminating each end of a straight line section of the slot dipole line, each spiral slot line having a length less than a quarter wavelength while being greater than a straight section of the slot dipole line and having a narrower slot width than the straight line section, the two inductive short-circuited spiral slot lines formed as mirror images of each other one each end of the straight line section of the slot dipole line.

13. The antenna of claim 12 further comprising:

a dimension of the substrate selected for sizing the antenna between $0.01\lambda_0$ and less than $0.50\ \lambda_0$.

14. The antenna of claim 12 further comprising:

a dimension of the substrate selected for sizing the antenna between $0.05\lambda_0$ and $0.25\ \lambda_0$.

15. The antenna of claim 12 further comprising:

a very high impedance on an order of 5,000 to 15,000.

16. The antenna of claim 12 further comprising:

a very high impedance on an order of 10,000.

17. The antenna of claim 12 further comprising:

each spiral slot line coiled in a pattern with a maximum dimension less than one-half of a length of a radiating slot section.

18. The antenna of claim 12 further comprising:

the slot dipole line including a folded slot line.

19. The antenna of claim 18 further comprising:

a coplanar waveguide line center-feeding the folded slot line.

20. The antenna of claim 12 further comprising:

an open ended microstrip line feeding the slot dipole line at a crossing point.

21. The antenna of claim 20 further comprising:

the microstrip line extending beyond the slot dipole line defining a second port with small capacitance.

22. The antenna of claim 21 further comprising:

a width of the microstrip line reduced at the crossing point of the slot dipole line.

23. A miniaturized antenna for sending and receiving a signal having a wavelength comprising:

a substrate;

a slot dipole line formed on the substrate with an electrical length less than a quarter wavelength and a short circuit at one end and an open circuit at an opposite end, the open circuit of the slot dipole line including two non-radiating spiral slots formed as symmetrical mirror images of one another and short circuited at one end, the slot dipole line having a radiating section with three line portions bent with respect to one another, where one line portion has a width less than a width of other line portions, the line portions extending angularly with respect to one another so that no line portion carries a magnetic current opposing a magnetic current of any other line portion; and an open ended microstrip line feeding the slot dipole line at a crossing point and extending less than a quarter wavelength.

* * * * *